US011805921B2

(12) United States Patent
Telford

(10) Patent No.: US 11,805,921 B2
(45) Date of Patent: Nov. 7, 2023

(54) ADJUSTABLE CHILD CARRIER WITH MULTIPLE CARRY ORIENTATIONS

(71) Applicant: The ERGO Baby Carrier, Inc., Los Angeles, CA (US)

(72) Inventor: Rodney V. Telford, Kula, HI (US)

(73) Assignee: The ERGO Baby Carrier, Inc., Torrance, CA (US)

( * ) Notice: Subject to any disclaimer, the term of this patent is extended or adjusted under 35 U.S.C. 154(b) by 55 days.

(21) Appl. No.: 17/353,284

(22) Filed: Jun. 21, 2021

(65) Prior Publication Data

US 2021/0393049 A1 Dec. 23, 2021

Related U.S. Application Data

(60) Provisional application No. 63/041,610, filed on Jun. 19, 2020.

(51) Int. Cl.
*A47D 13/02* (2006.01)
*A47D 15/00* (2006.01)

(52) U.S. Cl.
CPC ..... *A47D 13/025* (2013.01); *A47D 15/006* (2013.01)

(58) Field of Classification Search
CPC ..... A47D 13/025; A47D 15/006
See application file for complete search history.

(56) References Cited

U.S. PATENT DOCUMENTS 268,932 A 12/1882 Poirier
576,292 A 2/1897 Vanderburgh
982,376 A 1/1911 MacFarlane
2,212,746 A 8/1940 Nelson
2,599,474 A 6/1952 Mills
2,994,300 A 8/1961 Grahling
(Continued)

FOREIGN PATENT DOCUMENTS

AU 2012209531 A1 7/2013
AU 2013287314 A1 1/2015
(Continued)

OTHER PUBLICATIONS

European Application No. 21180405.9, Extended European Search Report, dated Nov. 9, 2021.
(Continued)

*Primary Examiner* — Derek J Battisti
(74) *Attorney, Agent, or Firm* — Erise IP, P.A.

(57) ABSTRACT

An adjustable child carrier includes waist belt, a main body, shoulder straps, side attachment tabs, and thigh supports. The side attachment tabs provide lower attachment points for the shoulder straps. The thigh supports cooperate with a seat center portion to form an adjustable bucket seat configurable in a plurality of bucket seat configurations adapted to ergonomically support a child in a corresponding size range in a spread squat position. The upper end portions of the thigh supports can be selectively coupled to the side attachment tabs at multiple mid-section width setting locations and the lower end portions of the thigh supports can be selectively coupled to the waist belt at multiple base width setting locations. The thigh supports are adjustable to set a mid-section width of the adjustable child carrier and a base width of the adjustable bucket seat.

20 Claims, 13 Drawing Sheets

(56) References Cited

U.S. PATENT DOCUMENTS 3,097,773 A 7/1963 Cunningham
3,229,873 A 1/1966 Hershman
3,275,373 A 9/1966 Card
3,327,914 A 6/1967 Abram
3,481,517 A 12/1969 Aukerman
3,780,919 A 12/1973 Hansson
3,840,162 A 10/1974 Horenstein et al.
3,871,562 A 3/1975 Grenier
3,964,654 A 6/1976 Wittenberger
4,009,808 A 3/1977 Sharp
D247,199 S 2/1978 Carter
4,139,131 A 2/1979 Hathaway
4,149,687 A 4/1979 Nunemacher
D253,558 S 12/1979 Carter
4,234,229 A 11/1980 Arnold
4,273,215 A 6/1981 Leggett
4,318,502 A 3/1982 Lowe et al.
4,324,430 A 4/1982 Dimas, Jr.
4,333,591 A 6/1982 Case
D266,800 S 11/1982 Kula et al.
4,361,259 A 11/1982 Chanter
4,402,440 A 9/1983 Purtzer et al.
4,434,920 A 3/1984 Moore
4,467,945 A 8/1984 Schaapveld
4,469,259 A 9/1984 Krich et al.
4,479,595 A 10/1984 Opsal
D276,478 S 11/1984 Fallon
4,480,775 A 11/1984 Stanford
4,492,326 A 1/1985 Storm
D277,811 S 3/1985 Moore
4,550,800 A 11/1985 Dietrich
4,579,264 A 4/1986 Napolitano
4,651,366 A 3/1987 Lande et al.
4,666,017 A 5/1987 Zimmerman
4,724,988 A 2/1988 Tucker
4,746,044 A 5/1988 Arvizu
4,765,279 A 8/1988 Klickstein
4,800,629 A 1/1989 Ikeda
4,867,464 A 9/1989 Cook
4,946,119 A 8/1990 Hellhake
4,986,458 A 1/1991 Linday
5,071,047 A 12/1991 Cordisco
5,076,598 A 12/1991 Nauman
D324,607 S 3/1992 Nelson
5,114,059 A 5/1992 Thatcher
5,129,406 A 7/1992 Magnusen et al.
D334,253 S 3/1993 Balzarini
5,205,450 A 4/1993 DeRosier
5,205,451 A 4/1993 Manzer
5,224,637 A 7/1993 Colombo
5,240,159 A 8/1993 Gregory
5,246,152 A 9/1993 Dotseth
5,284,279 A 2/1994 Sason et al.
5,325,818 A 7/1994 Leach
D357,800 S 5/1995 Roan et al.
5,490,620 A 2/1996 Bergqvist
D370,996 S 6/1996 Shimura et al.
5,522,528 A 6/1996 Petricola
5,564,612 A 10/1996 Gregory
5,570,823 A 11/1996 Lindy
D377,116 S 1/1997 Shimura et al.
D385,105 S 10/1997 Fair
5,673,828 A 10/1997 Raedel et al.
5,678,739 A 10/1997 Darling et al.
5,690,258 A 11/1997 Kataoka et al.
5,692,655 A 12/1997 Fair et al.
5,699,555 A 12/1997 Schunter
5,725,139 A 3/1998 Smith
D395,161 S 6/1998 Fair et al.
5,772,088 A 6/1998 Nelson
5,791,535 A 8/1998 Roan et al.
D397,867 S 9/1998 Fair et al.
5,799,851 A 9/1998 Wulf et al.
5,813,580 A 9/1998 Fair
5,819,341 A 10/1998 Simantob et al.
5,848,576 A 12/1998 Colaianni
5,848,741 A 12/1998 Fair
5,927,235 A 7/1999 Olaiz
5,934,528 A 8/1999 Higuchi
D414,032 S 9/1999 Howell
5,988,742 A 11/1999 Stevens
6,055,686 A 5/2000 Knight
6,073,820 A 6/2000 Drobinski
6,125,792 A 10/2000 Gee
6,155,579 A 12/2000 Eyman et al.
6,164,509 A 12/2000 Gausling et al.
6,179,175 B1 1/2001 Painter
D437,996 S 2/2001 Fair et al.
6,182,873 B1 2/2001 Christopher et al.
6,257,468 B1 7/2001 Yamazoe et al.
D453,066 S 1/2002 Norman
D455,546 S 4/2002 Norman
6,364,186 B1 4/2002 Gilmour et al.
6,409,060 B2 6/2002 Donine
6,415,969 B1 7/2002 Higuchi
6,443,339 B1 9/2002 Higuchi
6,499,165 B1 12/2002 Morgillo
6,520,391 B2 2/2003 Yen
6,598,771 B2 7/2003 Norman
6,609,642 B2 8/2003 Heinz et al.
D484,685 S 1/2004 Kassai et al.
6,681,973 B2 1/2004 Crumrine
D486,635 S 2/2004 Yagisawa et al.
6,715,651 B2 4/2004 Le Gal
6,722,543 B1 4/2004 Fitzgerald et al.
6,763,983 B2 7/2004 Norman
6,772,925 B2 8/2004 O'Hare
D507,869 S 8/2005 Liistro et al.
D509,056 S 9/2005 Shiraishi et al.
7,073,866 B1 7/2006 Berdahl
7,168,600 B2 1/2007 Hwang
7,204,462 B2 4/2007 Lembo
7,204,468 B2 4/2007 Kintzele
7,255,620 B1 8/2007 Shepherd
7,322,498 B2 1/2008 Frost
7,343,880 B2 3/2008 Bergkvist
7,494,031 B2 2/2009 Kassai et al.
D590,568 S 4/2009 Crutchfield
D597,788 S 8/2009 Ellis
D615,750 S 5/2010 Jones et al.
7,766,199 B1 8/2010 Caperon
D623,401 S 9/2010 Bergkvist et al.
D623,402 S 9/2010 Bergkvist et al.
D632,887 S 2/2011 Jones et al.
7,878,587 B1 2/2011 Leach
7,886,946 B2 2/2011 Gray
8,028,871 B2 10/2011 Gray
8,042,869 B2 10/2011 McClintock et al.
D649,345 S 11/2011 Bergkvist et al.
D655,495 S 3/2012 Sauer et al.
8,127,385 B1 3/2012 Goutevenier
8,172,116 B1 5/2012 Lehan et al.
D664,351 S 7/2012 Bergkvist et al.
8,272,546 B2 9/2012 Leistensnider
8,403,189 B2 3/2013 Nyberg et al.
8,408,435 B2 4/2013 Refsum
8,424,732 B1 4/2013 Lehan et al.
8,453,894 B2 * 6/2013 Jung ..... A47D 13/025 224/159
D692,227 S 10/2013 Andren et al.
8,579,168 B2 11/2013 Zack et al.
8,590,757 B2 11/2013 Frost
8,627,988 B2 1/2014 Bergkvist
8,636,181 B2 1/2014 Gunter et al.
8,650,663 B2 2/2014 Fair et al.
8,701,949 B1 4/2014 Lehan et al.
8,726,437 B2 5/2014 Hardesty
8,745,794 B1 6/2014 McDermott
8,752,739 B2 6/2014 Bergkvist
8,973,794 B2 3/2015 Bergkvist et al.
9,022,260 B2 5/2015 Frost
D733,419 S 7/2015 Wikner et al.
9,179,758 B2 11/2015 Calilung et al.
9,185,993 B2 11/2015 Telford et al.

(56) References Cited

U.S. PATENT DOCUMENTS

| | | | | |
|---|---|---|---|---|
| 9,220,352 | B2 | 12/2015 | Frost | |
| 9,314,113 | B1 | 4/2016 | Lehan et al. | |
| 9,357,852 | B2 | 6/2016 | Salazar et al. | |
| 9,357,854 | B2 | 6/2016 | Sundberg et al. | |
| 9,380,887 | B2 | 7/2016 | Frost | |
| 9,380,888 | B2 | 7/2016 | Telford et al. | |
| 9,439,515 | B2 | 9/2016 | Kim | |
| 9,713,391 | B2 | 7/2017 | Telford et al. | |
| 9,788,664 | B2 | 10/2017 | Andren | |
| D803,549 | S | 11/2017 | Warfaa et al. | |
| D807,025 | S | 1/2018 | Elmberg et al. | |
| 9,877,595 | B2 | 1/2018 | Wang | |
| 9,877,596 | B2 | 1/2018 | Schaarschmidt | |
| D811,082 | S | 2/2018 | Lehan | |
| 9,955,797 | B2 | 5/2018 | Telford et al. | |
| 10,076,194 | B2 | 9/2018 | Wikner et al. | |
| 10,159,357 | B2 | 12/2018 | Telford | |
| 10,172,478 | B2 | 1/2019 | Telford | |
| 10,264,895 | B2 | 4/2019 | Lindeman | |
| 10,271,663 | B2 | 4/2019 | Salazar | |
| D851,916 | S | 6/2019 | Bjorkenkvist et al. | |
| 10,426,275 | B2 | 10/2019 | Telford | |
| 10,433,656 | B2 | 10/2019 | Lundh | |
| 10,441,090 | B2 | 10/2019 | Lehan | |
| 10,506,885 | B2 | 12/2019 | Telford et al. | |
| 10,653,251 | B1 * | 5/2020 | Young | A47D 13/025 |
| 10,702,074 | B2 | 7/2020 | Najafi et al. | |
| 10,736,436 | B2 | 8/2020 | Telford | |
| 10,743,678 | B2 | 8/2020 | Salazar et al. | |
| 10,905,252 | B2 | 2/2021 | Fan | |
| D913,683 | S | 3/2021 | Lehan | |
| 11,026,521 | B2 | 6/2021 | Telford | |
| 11,051,634 | B2 | 7/2021 | Telford | |
| 11,191,368 | B2 | 12/2021 | Manouchehri et al. | |
| 11,219,317 | B2 | 1/2022 | Telford | |
| 11,272,791 | B2 | 3/2022 | Warner | |
| 11,297,957 | B2 | 4/2022 | Telford | |
| D955,102 | S | 6/2022 | Kleremo et al. | |
| 11,357,337 | B2 | 6/2022 | Dolk et al. | |
| 11,440,444 | B2 | 9/2022 | Shahbandar | |
| 11,684,175 | B2 | 6/2023 | Telford | |
| 2002/0011503 | A1 | 1/2002 | Hwang | |
| 2002/0175194 | A1 | 11/2002 | Norman | |
| 2003/0106916 | A1 | 6/2003 | Boone | |
| 2003/0178452 | A1 | 9/2003 | Norman | |
| 2004/0149790 | A1 | 8/2004 | Kassai et al. | |
| 2004/0155078 | A1 | 8/2004 | Hwang | |
| 2004/0238579 | A1 | 12/2004 | Krogh | |
| 2005/0045674 | A1 | 3/2005 | Rehbein | |
| 2005/0067549 | A1 | 3/2005 | Kintzele et al. | |
| 2005/0155995 | A1 | 7/2005 | Lee | |
| 2005/0184114 | A1 | 8/2005 | Hoff et al. | |
| 2005/0242136 | A1 | 11/2005 | Moriguchi et al. | |
| 2005/0279785 | A1 | 12/2005 | Liistro et al. | |
| 2006/0011678 | A1 | 1/2006 | Kassai et al. | |
| 2006/0076373 | A1 | 4/2006 | Labelle et al. | |
| 2006/0130220 | A1 | 6/2006 | Morgan et al. | |
| 2006/0261104 | A1 | 11/2006 | Zambrzycki | |
| 2007/0029356 | A1 | 2/2007 | Moriguchi et al. | |
| 2007/0057003 | A1 | 3/2007 | Keyes | |
| 2007/0241146 | A1 | 10/2007 | Nyberg et al. | |
| 2007/0293656 | A1 | 12/2007 | Caravan et al. | |
| 2008/0047987 | A1 | 2/2008 | Price | |
| 2008/0283561 | A1 | 11/2008 | Parness | |
| 2010/0025441 | A1 | 2/2010 | Blaney | |
| 2010/0072236 | A1 | 3/2010 | Parness et al. | |
| 2010/0147910 | A1 | 6/2010 | Schachtner | |
| 2010/0187269 | A1 | 7/2010 | Leistensnider | |
| 2010/0308087 | A1 | 12/2010 | Lindbloom | |
| 2010/0308088 | A1 | 12/2010 | Lindblom | |
| 2011/0062195 | A1 | 3/2011 | Jones et al. | |
| 2011/0101051 | A1 | 5/2011 | Parness | |
| 2011/0163136 | A1 | 7/2011 | Billingham | |
| 2011/0290831 | A1 * | 12/2011 | Wang | A47D 13/025 224/160 |
| 2012/0037284 | A1 | 2/2012 | Korbonski | |
| 2012/0043359 | A1 | 2/2012 | Bergkvist et al. | |
| 2012/0061429 | A1 | 3/2012 | Sauer | |
| 2012/0187161 | A1 | 7/2012 | Bergkvist | |
| 2012/0187162 | A1 | 7/2012 | Bergkvist et al. | |
| 2012/0205406 | A1 | 8/2012 | Schachtner | |
| 2012/0241487 | A1 | 9/2012 | Zack et al. | |
| 2012/0298702 | A1 | 11/2012 | Jung | |
| 2014/0097215 | A1 | 4/2014 | Caperon | |
| 2014/0167462 | A1 | 6/2014 | Lai et al. | |
| 2014/0263491 | A1 * | 9/2014 | Telford | A47D 13/025 224/160 |
| 2014/0284361 | A1 | 9/2014 | Wang | |
| 2014/0319189 | A1 | 10/2014 | Hoppener-Visser | |
| 2015/0069097 | A1 | 3/2015 | Lindblom | |
| 2015/0208821 | A1 | 7/2015 | Frost | |
| 2015/0223614 | A1 | 8/2015 | Pos | |
| 2015/0272342 | A1 | 10/2015 | Schaarschmidt | |
| 2015/0374139 | A1 | 12/2015 | Salazar et al. | |
| 2016/0015187 | A1 | 1/2016 | Telford et al. | |
| 2016/0150893 | A1 | 6/2016 | Salazar et al. | |
| 2016/0227940 | A1 | 8/2016 | Wikner et al. | |
| 2016/0270555 | A1 | 9/2016 | Telford et al. | |
| 2016/0278537 | A1 | 9/2016 | Frost | |
| 2016/0296034 | A1 | 10/2016 | Telford | |
| 2016/0316933 | A1 | 11/2016 | Antunovic | |
| 2017/0119173 | A1 | 5/2017 | Telford | |
| 2017/0150826 | A1 * | 6/2017 | Salazar | A47D 13/025 |
| 2017/0196374 | A1 * | 7/2017 | Chen | A47D 13/025 |
| 2017/0251829 | A1 | 9/2017 | Telford et al. | |
| 2018/0000258 | A1 | 1/2018 | Lehan | |
| 2018/0116426 | A1 | 5/2018 | Telford | |
| 2018/0184813 | A1 | 7/2018 | Salazar | |
| 2018/0192788 | A1 | 7/2018 | Telford et al. | |
| 2018/0199730 | A1 | 7/2018 | Lundh | |
| 2018/0206653 | A1 * | 7/2018 | Andrus | A47D 13/025 |
| 2018/0235379 | A1 | 8/2018 | Lindeman et al. | |
| 2018/0296005 | A1 | 10/2018 | Tsai | |
| 2019/0014920 | A1 * | 1/2019 | Matsuyama | A47D 13/025 |
| 2019/0075936 | A1 | 3/2019 | Salazar et al. | |
| 2019/0075937 | A1 | 3/2019 | Salazar | |
| 2019/0090657 | A1 | 3/2019 | Telford | |
| 2019/0150633 | A1 | 5/2019 | Flaunty | |
| 2019/0223619 | A1 | 7/2019 | Lindeman | |
| 2019/0350379 | A1 | 11/2019 | Antunovic | |
| 2019/0380508 | A1 | 12/2019 | Telford et al. | |
| 2020/0077806 | A1 | 3/2020 | Telford | |
| 2020/0146464 | A1 | 5/2020 | Manouchehri et al. | |
| 2020/0163466 | A1 | 5/2020 | Telford | |
| 2020/0253392 | A1 | 8/2020 | Sahadi et al. | |
| 2020/0268169 | A1 | 8/2020 | Telford | |
| 2021/0059431 | A1 | 3/2021 | Elmberg | |
| 2021/0186234 | A1 | 6/2021 | Dolk et al. | |
| 2021/0361079 | A1 | 11/2021 | Salazar et al. | |
| 2021/0393049 | A1 | 12/2021 | Telford | |
| 2022/0176853 | A1 | 6/2022 | Shahbandar | |

FOREIGN PATENT DOCUMENTS

| | | | |
|---|---|---|---|
| AU | 2015377212 | A1 | 8/2017 |
| CA | 1332928 | | 11/1994 |
| CA | 2159241 | | 9/1995 |
| CA | 2 240 015 | | 1/2000 |
| CA | 2240015 | A1 | 1/2000 |
| CA | 154976 | A | 9/2014 |
| CA | 3160906 | A1 | 11/2022 |
| CN | 203873395 | U | 10/2014 |
| CN | 104411213 | A | 3/2015 |
| CN | 204363531 | U | 6/2015 |
| CN | 105377085 | A | 3/2016 |
| CN | 106263837 | A | 1/2017 |
| CN | 108244885 | A | 7/2018 |
| CN | 109480542 | A | 3/2019 |
| CN | 109480543 | | 3/2019 |
| CN | 110897429 | A | 3/2020 |
| CN | 115399601 | A | 11/2022 |
| DE | 29519530 | U1 | 4/1996 |
| DE | 22912951 | U1 | 1/2000 |
| DE | 20116046 | | 1/2002 |

(56) References Cited

FOREIGN PATENT DOCUMENTS

| | | | |
|---|---|---|---|
| DE | 202008014412 | U1 | 9/2009 |
| DE | 6020080000939 | | 5/2010 |
| DE | 202010011906 | | 11/2010 |
| DE | 202010011906 | U1 | 12/2010 |
| DE | 202011103052 | U1 | 8/2011 |
| DE | 202012104318 | | 11/2012 |
| DE | 202014100616 | U1 | 6/2014 |
| EP | 0046672 | | 3/1982 |
| EP | 0437365 | A1 | 7/1991 |
| EP | 0662292 | | 7/1995 |
| EP | 0 995 380 | | 10/1998 |
| EP | 0995380 | A1 | 4/2000 |
| EP | 1055382 | | 11/2000 |
| EP | 15911044 | A1 | 11/2005 |
| EP | 1707082 | | 10/2006 |
| EP | 1893058 | A1 | 3/2008 |
| EP | 1992257 | A1 | 11/2008 |
| EP | 1765123 | | 6/2011 |
| EP | 2421413 | A1 | 2/2012 |
| EP | 2667747 | A1 | 12/2013 |
| EP | 2667748 | A1 | 12/2013 |
| EP | 2810587 | A1 | 12/2014 |
| EP | 2872012 | A1 | 5/2015 |
| EP | 3054813 | A1 | 8/2016 |
| EP | 3244778 | A1 | 11/2017 |
| EP | 4094639 | A1 | 11/2022 |
| ES | 251704 | | 10/1980 |
| ES | 2585565 | | 10/2016 |
| FR | 1 545 820 | | 9/1967 |
| FR | 2 524 288 | | 10/1983 |
| FR | 2524288 | | 10/1983 |
| FR | 2 794 010 | | 5/1999 |
| FR | 2 794 010 | | 1/2000 |
| FR | 2794010 | A1 | 12/2000 |
| FR | 2806279 | | 9/2001 |
| FR | 2823655 | A1 | 10/2002 |
| FR | 2 851 436 | | 8/2004 |
| FR | 2851436 | A1 | 8/2004 |
| GB | 2026848 | A | 8/1978 |
| GB | 2028633 | | 3/1980 |
| GB | 2314026 | | 12/1987 |
| GB | 2260687 | | 4/1993 |
| GB | 2346314 | A | 8/2000 |
| ID | 201800806 | | 1/2018 |
| JP | 53-146441 | | 4/1952 |
| JP | 53-155443 | | 12/1978 |
| JP | 54-108131 | | 7/1979 |
| JP | 58-95766 | | 6/1983 |
| JP | 59-21273 | | 2/1984 |
| JP | 63-187956 | | 12/1988 |
| JP | 1-72158 | | 5/1989 |
| JP | 2-124107 | | 5/1990 |
| JP | 09-099842 | | 10/1995 |
| JP | 9-121987 | | 5/1997 |
| JP | 09-173185 | | 8/1997 |
| JP | 10-313929 | | 2/1998 |
| JP | 10-108764 | | 4/1998 |
| JP | 10201580 | A | 8/1998 |
| JP | 11046938 | | 2/1999 |
| JP | U3073766 | | 12/2000 |
| JP | 2002186543 | A | 7/2002 |
| JP | 3403599 | | 5/2003 |
| JP | 2003225119 | | 8/2003 |
| JP | 2005-131146 | | 10/2003 |
| JP | 2005-185426 | | 12/2003 |
| JP | 2004000687 | | 1/2004 |
| JP | 2004154468 | | 6/2004 |
| JP | 2005052584 | | 3/2005 |
| JP | 2005118472 | | 5/2005 |
| JP | 2005-288107 | | 10/2005 |
| JP | 2005-312826 | | 11/2005 |
| JP | 2005312823 | A | 11/2005 |
| JP | 4170894 | B2 | 10/2008 |
| JP | 2013-118900 | | 12/2011 |
| JP | 2012-187352 | | 10/2012 |
| JP | 2012524603 | | 10/2012 |
| JP | 2014176494 | | 9/2014 |
| JP | 2016512124 | A | 4/2016 |
| JP | 6130251 | B2 | 5/2017 |
| JP | 108135370 | A | 6/2018 |
| JP | 6485931 | B2 | 3/2019 |
| JP | 65030576 | B1 | 6/2019 |
| JP | P2001-104115 | | 4/2021 |
| KR | 2000508690000 | | 10/2000 |
| KR | 1020020008534 | | 1/2002 |
| KR | 2003126950000 | | 4/2003 |
| KR | 2003158200000 | | 6/2003 |
| KR | 2003182590000 | | 6/2003 |
| KR | 2003201940000 | | 7/2003 |
| KR | 20-0324019 | | 8/2003 |
| KR | 2003337880000 | | 11/2003 |
| KR | 10-2004-0064749 | | 7/2004 |
| KR | 20060047603 | | 5/2006 |
| KR | 10-2007-0039806 | | 4/2007 |
| KR | 20-2009-0008715 | | 8/2009 |
| KR | 20-0447518 | | 1/2010 |
| KR | 20-2010-0010120 | | 10/2010 |
| KR | 20-2011-0005263 | | 5/2011 |
| KR | 101134560 | B2 | 4/2012 |
| KR | 200459659 | Y1 | 4/2012 |
| KR | 1020120070544 | A | 6/2012 |
| KR | 200462354 | Y1 | 9/2012 |
| KR | 101197918 | B1 | 11/2012 |
| KR | 1020130107167 | A | 10/2013 |
| KR | 101426751 | B1 | 8/2014 |
| KR | 20-0477837 | | 7/2015 |
| KR | 1020160112243 | A | 9/2016 |
| KR | 20180031827 | A | 3/2018 |
| KR | 101929748 | B1 | 12/2018 |
| NZ | 733728 | | 7/2017 |
| PH | 1207501292 | A1 | 2/2018 |
| PH | 12022050229 | B | 4/2023 |
| SG | 11201705794 | | 1/2015 |
| TW | 201332466 | A | 8/2013 |
| WO | WO 199505952 | A1 | 3/1995 |
| WO | WO 200189978 | A1 | 11/2001 |
| WO | WO 2009034233 | | 3/2009 |
| WO | WO 2010123447 | | 10/2010 |
| WO | WO 2011011158 | | 1/2011 |
| WO | WO 2011071441 | | 6/2011 |
| WO | WO 2012079787 | | 6/2012 |
| WO | 2012109467 | A1 | 8/2012 |
| WO | 2013079296 | A1 | 6/2013 |
| WO | WO 2014033134 | A1 | 3/2014 |
| WO | 2014160355 | A1 | 10/2014 |
| WO | WO 2014160355 | A1 | 10/2014 |
| WO | WO 2015053696 | | 4/2015 |
| WO | 2016153411 | A1 | 9/2016 |
| WO | 2017075500 | A1 | 5/2017 |
| WO | WO 2017095752 | A1 | 6/2017 |
| WO | 2018081603 | A1 | 5/2018 |
| WO | 2020163585 | A1 | 8/2020 |

OTHER PUBLICATIONS

Office Action for U.S. Appl. No. 10/937,193, dated Aug. 14, 2007, 9 pgs.

Office Action for U.S. Appl. No. 11/949,324, dated Oct. 6, 2009, 9 pgs.

Office Action for U.S. Appl. No. 11/949,324, dated Apr. 28, 2010, 9 pgs.

International Search Report and Written Opinion for PCT Application No. PCT/US2004/029614, completed on Feb. 11, 2005, dated Mar. 3, 2005, 9 pgs.

International Preliminary Report on Patentability for PCT/US2004/029614, dated Mar. 13, 2006, 7 pgs.

Examination Report for European Application No. 04783725.7, dated Sep. 21, 2007, 3 pgs.

Examination Report for European Application No. 04783725.7, dated Sep. 9, 2008, 4 pgs.

Examination Report for European Application No. 04783725.7, dated Sep. 10, 2009, 3 pgs.

(56) References Cited

OTHER PUBLICATIONS

Examination Report for European Application No. 04783725.7, dated Dec. 21, 2009, 5 pgs.
Examination Report for European Application No. 04783725.7, dated Jun. 1, 2010, 6 pgs.
Office Action for U.S. Appl. No. 11/949,324, dated Oct. 4, 2010, 10 pgs.
Office Action for U.S. Appl. No. 11/949,324, dated Jul. 18, 2011, 14 pgs.
Notice of Opposition filed on Mar. 13, 2012, against European Patent No. EP1765123 B1, 213 pgs.
Declaration of Judy Petterson regarding BabyTrekker with enclosures 1 and 2, dated May 26, 2011, 18 pgs.
International Search Report and Written Opinion for International Application No. PCT/US2014/026378, dated Jul. 21, 2014, 10 pgs.
Office Action for U.S. Appl. No. 14/685,235, dated May 22, 2015, 8 pgs.
International Preliminary Report on Patentability (Ch. I) for International Patent Application No. PCT/US2014/026378, dated Sep. 15, 2015, 6 pgs.
Office Action for U.S. Appl. No. 14/862,933, dated Oct. 30, 2015, 5 pgs.
Office Action for U.S. Appl. No. 14/685,235, dated Nov. 27, 2015, 8 pgs.
International Search Report and Written Opinion for International Patent Application No. PCT/US2016/026626, dated Jun. 30, 2016, 7 pgs.
Office Action for U.S. Appl. No. 15/177,114, dated Aug. 24, 2016, 10 pgs.
Baby Matey Soft Baby Carriers Literature, Kidpower Unlimited Inc., Toronto, ON, CA, 10 pgs.
BabyTrekker Instruction Manual, Petterson Infant Products, Flin Flon, MB, CA, 1998, 16 pgs.
Declaration of Richard N. Hinrichs, Ph.D and Appendix A thereto for Petition for Inter Partes Review of U.S. Pat. No. 9,022,260, 158 pgs.
Declaration of Richard N. Hinrichs, Ph.D and Appendix A thereto for Petition for Inter Partes Review of U.S. Pat. No. 8,590,757, 155 pgs.
Declaration of Shari Hall White and Appendix A thereto, Jun. 29, 2016, 12 pgs.
Declaration of Judy Pettersen and Exhibits thereto, Aug. 14, 2016, 50 pgs.
Nov. 24, 1998 Letter from U.S. ITC regarding U.S. tariff classification of babyTrekker, 2 pgs., retrieved from http://www.faqs.org/rulings/rulings1998NYD83381.html).
Feb. 2002 forum post from "USA", 2 pgs., retrieved from http://windsorpeak.com/vbulletin/showthread.php?185543-baby- bjorn-and-large-husband).
U.S. Trademark Serial No. 75057147 Documents, U.S. Patent and Trademark Office, 44 pgs.
Complaint, *The Ergo Baby Carrier, Inc.* v. *BOBA Inc.*, Case No. 2:15-cv-08946, In the United States District Court for the Central District of California, filed Nov. 17, 2015, 7 pgs.
Blaffer Hardy, S., Family Planning Primate Style, Mother Nature—A History of Mothers, Infants and Natural Selection, 2000, pp. 197-204.
Longe, Jaqueline L., Baby Carrier, How Products are Made: An Illustrated Guide to Product Manufacturing, 2001, vol. 6, pp. 22-26.
Pelot, Ron P., et al., "Background Document for an Advanced Personal Load Carriage System for the Canadian forces", Ergonomics Research Group, Queen's University, Kingston, ON, CA, Mar. 29, 1995, 148 pgs.
Brewer, Gail S., A Quick Guide for Starting Right, Baby Carriers, Right from the Start: Meeting the Challenges of Mothering Your Unborn and Newborn Baby, 1981, pp. 159-160.
Salter, R.B., "Etiology, Pathogenesis and Possible Prevention of Congenital Dislocation of the Hip", The Canadian Medical Association Journal, vol. 98, No. 20, May 18, 1968.
Jones, Sandy, Getting Around, Guide to Baby Products, Consumers Digest, 2001, pp. 41, 55-60, 157-160, 199-201.
Gilligan, Shannon, Best for Baby: A Selective Consumer's Guide to Products and Services from Infancy to Preschool, 1988, pp. 41-46.
O'Donohue, Rosaleen, Baby Rides the Asian Way, The Australian Women's Weekly, Jul. 23, 1969 at p. 9.
Doan, Marlyn, Children's Gear, Starting Small in the Wilderness, The Sierra Club Outdoors Guide for Families, 1979, at pp. 161-167.
Guide to the Ann Moore Innovative Lives Presentation, 1999, Archives Center, National Museum of American History, Smithsonian Institute, Aug. 2010, 12 pgs., retrieved from http://amhistory.si.edu/archives/AC0706.pdf).
Warren, A.J., "The Mom Who Invented the Snugli", CBS News, Mar. 6, 2001, 4 pgs., retrieved from http://www.cbsnews.com/news/the-mom-who-invented-the- snugli/.
Bach, John, "Practical Inventor Influenced American Culture", University of Cincinnati UC Magazine, Aug. 2010, 6 pgs.
"Eager Market for Baby Carrier" The Gazette, Montreal May 15, 1984: C-19 (accessed at https://news.google.com/newspapers?id=zA0vAAAAIBAJ&sjid=mqUFAAAAIBAJ&pg=1454%2C2468510).
Roseman, E., et al., Baby Carriers, The Canadian Parents' Sourcebook, 1986, at pp. 149-153.
Rafelman, Rachel, The Portable Baby, Baby Gear for the First Year, 1997, pp. 40-41.
Laury, Jean Ray, Baby Carrier, A Treasury of Needlecraft Gifts for the New Baby, 1976, pp. 90-93.
Byrnes, E.A., "A Blue-Jean 'Person Pack': Toting the Tot on the Trail", The Mother Earth News, No. 75, May/Jun. 1982, p. 164.
The Kozy Family, 16 pgs., retrieved from Web Archives of http://www.kozycarrier.homestead.com/.
Packababy, 17 pgs., retrieved from Web Archives of http://www.packababy.com/.
Welcome to Sutemigear, 10 pgs., retrieved from Web Archives of http://sutemigear.com/.
"The Pick of the Extended Trek Packs" Backpacker, Oct. 1997, vol. 23, pp. 58-69.
Jones, Sandy, Back Packs and Soft Carriers, Guide to Baby Products, Consumers Reports, 1991, pp. 9-15.
Baby Trekker—Advantages, 2 pgs., retrieved from https://web.archive.org/web/20000708141511/http://www.babytrekker.com/advantages.htm.
Evenflo Soft Carriers, 2 pgs., retrieved from https://web.archive.org/web/20010331081113/http://www.evenflo.com/ep/furniture/softcarrier.phtml.
Newspaper ad for Napsak Soft Baby Carrier by Evenflow, The Pittsburgh Press (Pittsburgh, Pennsylvania), Thursday, Dec. 12, 1991, p. 57.
Pelot, R.P. et al., "A Static Biomechanical Load Carriage Model", RTO HFM Specialist Meeting on Soldier Mobility Innovation in Load Carriage System Design and Evaluation, Kingston, CA, Jun. 27-29, 2000, 13 pgs.
Knapik, J., "Physiological, Biomechanical and Medical Aspects of Soldier Load Carriage", RTO HFM Specialist Meeting on Soldier Mobility Innovation in Load Carriage System Design and Evaluation, Kingston, CA, Jun. 27-29, 2000, 20 pgs.
Holewijn, M., "Physiological Strain Due to Load Carrying", European Journal of Applied Physiology, 1990, 61:237-245.
Frame Carriers, 1 pg., retrieved from https://web.archive.org/web/20000526184535/http://www.evenflo.com/ep/furniture/framecarrier.phtml.
Aronson, D.D. et al., "Developmental dysplasia of the hip", Pediatrics, Aug. 1994, vol. 94(2), 202, 11 pgs.
Hodgson, A.R., "Congenital Dislocation of the Hip", British Medical Journal, Septermber 7, 1961, p. 647.
Leveau, Barney F., et al., "Developmental biomechanics," Physical Therapy, 64.12, 1984:1878.
The Age, Mar. 5, 1970 at p. 14.
Certified Translation of "What parents should watch out for when buying babywearing carriers" by Kirkiliones, retrieved from http://web.archive.org/web/20010719033113/http://www.continuu m-concept.de/liedkir.htm).

(56) References Cited

OTHER PUBLICATIONS

Kirkilionis, E., Das Tragen des Sauglings im Hüftsitz—eine spezielle Anpassung des menschlichen Traglings. Zoologische Jahrbücher, 1992, 96 (3), 395-415.
Kirkilionis, E., Worauf Eltern beim Kauf von Tragehilfen für Säuglinge achten sollten, 1994.
Kirkilionis, E., Die Grundbedürfnisse des Säuglings und deren medizinische Aspekte—dargestellt und charakterisiert am Jungentypus Tragling. notabene medici, 1997, 27 (2), 61-66, 27 (3), 117-121.
Kirkilionis, E., Ein Baby will gatragen sein, 1999, 171 pgs.
"The Beginning" Ergo Baby Blog, 13 pgs., retrieved from https://blog.ergobaby.com/2011/02/the-beginning/).
REI—Kelty Kangaroo Child Carrier, 2 pgs., retrieved from https://web.archive.org/web/19970222133805/http://rei.com/shopp ing/store3/CAMPING/BABY_CARRIERS/BABY_CARRIERS/bud/617589.html.
Tough Traveler, Kidsystems, 3 pgs., retrieved from http://web.archive.org/web/20011106132550/http://www.toughtraveler.com/cat7.html.
Mackie, H.W. et al., "The effect of simulated school load carriage configurations on shoulder strap tension forces and shoulder interface pressure", Applied Ergonomics, 36, 2005, pp. 199-206.
Hinrichs, et al., "An Investigation of the Inertial Properties of Backpacks Loaded in Various Configurations", United States Army Natick, Research and Development Laboratories, Natick, MA, 1982, 75 pgs.
Nelson, et al., "Effects of Gender, Load, and Backpack on Easy Standing and Vertical Jump Performance vol. II", United States Army Natick, Research and Development Laboratories, Natick, MA, Mar. 1982, 77 pgs.
Martin, et al., "Effects of Gender, Load, and Backpack on the Temporal and Kinematic Characteristics of Walking Gait vol. III", United States Army Natick, Research and Development Laboratories, Natick, MA, Apr. 1982, 77 pgs.
Martin, et al., "A Mathematical Model of the Inertial Properties of a Carrier-Backpack System vol. IV", United States Army Natick, Research and Development Laboratories, Natick, MA, May 1982, 89 pgs.
Definition of "flexed", Random House Webster's Unabridged Dictionary, Oct. 1999, Second Edition, p. 733.
Rose, Marion, Baby Carriers—Cultural History, Aware Parenting, Dec. 8, 2006, 11 pgs., retrieved from http://awareparenting.blogspot.com/2006/12/baby-carriers-cultural-history.html.
European Search Report for European Application No. 14773586.4, dated Oct. 16, 2016, 9 pgs.
International Search Report and Written Opinion for International Patent Application No. PCT/US2016/059534, dated Jan. 3, 2017, 8 pgs.
Office Action for Chinese Patent Application No. 201480023993.2, dated Jan. 11, 2017, 20 pgs.
Holewijn, Michael, "Physiological Strain Due to Load Carrying," European Journal of Applied Physiology and Occupational Physiology, Feb. 1990, 10 pgs.
BabyTrekker Instruction Manual, Pettersen Infant Products, Canada, 1998, 16 pgs.
BabyTrekker Instruction Manual, Pettersen Infant Products, Canada, 16 pgs.
Casses, R., "Infant Carriers and Spinal Stress," <<http://continuum-concept.org/reading/spinalstress.html>>, Jun. 16, 2002, 3 pgs.
Jones, S., "Guide to Baby Products," Consumer Reports, Completely Revised Seventh Edition, 2001, 21 pgs.
<<http://www. kelty.com/Kelty/index.cfm?fuseaction=Kids.ShowProduct&type=carrier&ID=12>>, Aug. 5, 2002, 1 page.
"Kwik Sew," Pattern 1046, Kwik Sew Pattern Co., Inc., Minneapolis, MN, 8 pgs.
Declaration of Judy Pettersen regarding BabyTrekker, May 26, 2011, 18 pgs.
"The Baby Trekker Product Info," <<http://www.babytrekker.com/product.htm>>, Jun. 10, 2002, 1 page.
"The Baby Trekker Testimonials," <<http://www.babytrekker.com/testimonials.htm>>, Dec. 21, 2001, 4 pgs.
"The Baby Trekker Testimonials," <<http://www.babytrekker.com/testimonials.htm>>, Sep. 16, 2002, 4 pgs.
"Baby/Toddler Sling," <<http://www3.telus.net/public/a6a83106/Sling/sling.html>>, Nov. 19, 2003, 5 pgs.
"First Journey Advantages," <<http://www.first-journey.com/advantage1pics/advantages1.html>>, Dec. 14, 2002, 1 page.
"First Journey Advantages," <<http://www.first-journey.com/advantage2pics/advantages2.html>>, Dec. 14, 2002, 1 page.
"First Journey Instructions," <<http://www.first-journey.com/instructions/instructions>>, Dec. 14, 2002, 1 page.
"First Journey Photos & Quotes," <<http://www.first-journey.com/photosandquotes/photos>>, Dec. 14, 2002, 2 page.
First Journey Brochure, <<www.first-journey.com>>, 2002, 2 pgs.
<<http://koti.welho.com/skoivune/sakara/english/about/index.html>>, Apr. 30, 2003, 2 pgs.
<<http://koti.welho.com/skoivune/sakara/english/index.html>>, Jun. 24, 2003, 2 pgs.
<<http://koti.welho.com/skoivune/sakara/english/guide/index.html>>, Jun. 28, 2003, 1 page.
<<http://koti.welho.com/skoivune/sakara/english/guide/ohje2.html>>, May 1, 2003, 1 page.
<<http://koti.welho.com/skoivune/sakara/english/guide/ohje3.html>>, May 1, 2003, 1 page.
<<http://koti.welho.com/skoivune/sakara/ohje/ohje4.html>>, May 2, 2003, 1 page.
<<http://koti.welho.com/skoivune/sakara/ohje/ohje6.html>>, May 29, 2003, 1 page.
<<http://koti.welho.com/skoivune/sakara/ohje/ohje7.html>>, May 9, 2003, 1 page.
<<http://koti.welho.com/skoivune/sakara/english/order/index.html>>, Apr. 30, 2003, 1 page.
<<http://koti.welho.com/skoivune/sakara/index2.html>>, Jun. 20, 2003, 2 pgs.
<<http://koti.welho.com/skoivune/sakara/sakarat/index.html>>, Apr. 30, 2003, 2 pgs.
Weego Soft Baby Carrier, Instructions for Use, Weego Babytragesäcke, Berlin, DE, 4 pgs.
<<http://www.weego.com/coinf.html>>, Aug. 6, 2002, 2 pgs.
<<http://www.weego.com/product.html>>, Dec. 11, 2001, 1 page.
<<http://www.weego.com/fabric.html>>, Nov. 2, 2001, 2 pgs.
<<http://www.weego.com/preem.html>>, Aug. 6, 2002, 2 pgs.
<<http://www.weego.com/acatalog/ool.html>>, Jun. 5, 2002, 3 pgs.
<<http://www.weego.de/024.htm>>, Aug. 12, 2003, 1 page.
<<http://www.weego.de/english/024.htm>>, Apr. 23, 2004, 1 page.
<<http://www.weego.de/english/ortho.htm>>, Jun. 1, 2004, 1 page.
<<http://www.weego.de/english/design.htm>>, Mar. 24, 2004, 1 page.
<<http://www.weego.de/english/interaktiv.htm>>, Jul. 3, 2004, 1 page.
<<http://www.weego.de/english/trageposition.htm>>, Apr. 23, 2004, 1 page.
"6 in One Rider," Infantino, LLC, San Diego, California, 2002, 1 page.
Assorted Photos, U.S. Appl. No. 60/501,396, filed Sep. 10, 2003, 3 pgs.
Wormleighton, A., "Baby Gifts: To Sew, Applique, Crochet and Knit," Copyright Marshall Cavendish Limited, 1998, 13 pgs.
"Baby Pack Baby Carrier," <<http://www.beginnings.org/shop/buikrugdragers_babypack.htm>>, Feb. 4, 2002, 1 page.
"Baby Trekker Instruction Sheet," 2 pgs.
Constance, S., "Backpacking the Baby," Sydney Morning Herald, Dec. 1, 1998, 3 pgs.
File History for U.S. Appl. No. 14/685,235, filed Apr. 13, 2015, 460 pgs.
"Chinese Baby Carrier," <<http://portebebe.free.fr>>, Jun. 2002, 7 pgs.
Coff, H., "Cut Scheduling for Optimum Fabric Utilization in Apparel Production," Georgia Institute of Technology, Nov. 1976, 141 pgs.
"Baby Matey, Soft Baby Carriers," Copyright Kidpower Unlimited Inc., 4 pgs.

(56) References Cited

OTHER PUBLICATIONS

"Theodore Bean Infants & Toddlers Carriers & Accessories," Theodore Bean Adventure Company Inc., 2000, 16 pgs.
"Clinical Practice Guideline: Early Detection of Developmental Dysplasia of the Hip," American Academy of Pediatrics vol. 105, No. 4, Apr. 2000, 10 pgs.
File History for European Patent Application No. 04783725.7, filed Sep. 10, 2004, 693 pgs.
"First Journey Visite Guidée," Pettersen Infant Products, www.first-journey.com, 2004, 2 pgs.
"First Journey Tour Guide," Pettersen Infant Products, www.first-journey.com, 2002, 2 pgs.
"Graco Soft Carrier Owner's Manual, Model 5070 Series," Graco Children's Products, Inc., 1999, 7 pgs.
Jones et al., "Guide to Baby Products," Consumer Reports Books, Fourth Edition, Dec. 1995, 10 pgs.
Harman et al., "The Effects of Backpack Weight on the Biomechanics of Load Carriage," Military Division, U.S. Army Research Institute of Environmental Medicine, May 3, 2000, 72 pgs.
"In & Out Carrier Instructions," Hauck Fun for Kids, 2003, 3 pgs.
"In & Out Carrier Instructions," Hauck Fun for Kids, Aug. 2003, 3 pgs.
"Wearing Your Baby," <<http://wearingyourbaby.co.nz/history>>, 2014, 11 pgs.
Longe, J., "How Products are Made: An Illustrated Guide to Product Manufacturing," 2001, vol. 6, 8 pgs.
"GVP Gear G4," <<http://www.gvpgear.com/g4.asp>>, Jun. 2, 2002, 3 pgs.
"Backpack Tips," <<http://backpacking.net/gearpack-tips.html>>, Jun. 2, 2002, 6 pgs.
"Make Your Own G4 Pack," <<http://www.gvpgear.com/make_your_own.asp>>, Jun. 2, 2002, 17 pgs.
King, F.H, "Farmers of forty Centuries," Copyright 2002 Blackmask Online, www.blackmask.com, 118 pgs.
"Worauf Eltern beim Kauf von Tragehilfen fuer Sauglinge achten sollten"—Things parents shopping for infant carriers should look out for, <<http://www.continuum-concept.de/liedkir.htm>>, Jul. 19, 2001, 4 pgs.
"Lifter Baby Carrier," <<http://www.beginnings.org/shop/buikheuprugdragers_lifter.htm>>, Jun. 19, 2002, 2 pgs.
"Ultralight Pack," <<http://www.backpacking.net/makegear/gvp-pack/>>, Mar. 1, 2003, 29 pgs.
Martin, J. and Hooper, R., "Military Load Carriage: A Novel Method of Interface Pressure Analysis," RTO HFM Specialists' Meeting on "Soldier Mobility: Innovations in Load Carriage System Design and Evaluation," Jun. 27-29, 2000, 9 pgs.
"Miguel Inspired Originals," <<http://miguelinspired.com/about.html>>, Oct. 30, 2005, 2 pgs.
"Miguel Inspired Originals," <<http://miguelinspired.com/gpage2.html>>, Oct. 30, 2005, 5 pgs.
"Miguel Inspired Originals," <<http://miguelinspired.com/gpage.html>>, Oct. 30, 2005, 2 pgs.
"Miguel Inspired Originals," <<http://miguelinspired.com/gpage3.html>>, Oct. 30, 2005, 1 page.
"The Australian Women's Weekly," vol. 37, No. 8, Jul. 23, 1969, 80 pgs.
"For Shane Gould Innes—Motherhood is a Mind," The Australian Women's Weekly, <<National library of Australia—http://nla.gov.au/nla-news-page5623013>>, Oct. 11, 1978, 1 page.
". . . Blowing Experience," The Australian Women's Weekly, <<National library of Australia—http://nla.gov.au/nla-news-page5623014>>, Oct. 11, 1978, 1 page.
Cessnock Eagle and South Mattland Recorder, vol. 32, No. 4162, Jun. 22, 1944, <<National library of Australia—http://nla.gov.au/nla-news-page10625124>>, 1 page.
File History for U.S. Appl. No. 10/937,193, filed Sep. 9, 2004, 135 pgs.
"Porte-bébé chinois," <<http://portebebe.free.fr/>>, Jun. 5, 2002, 6 pgs.
U.S. Appl. No. 60/501,396, filed Sep. 10, 2003, 9 pgs.
"Device for Worn Baby," Patent Translate Description of Russian Application No. RU12646, 3 pgs.
Santa Cruz Sentinel, <<https://www.newspapers.com/image/71319712>>, Jul. 26, 1987, 1 page.
Krantz, L. and Ludman-Exley, S., "The Best of Everything for Your Baby," Copyright 2000 by Prentice Hall, Inc., 18 pgs.
"Home Watch," The Sydney Morning Herald, <<https://www.newspapers.com/image/123957115>>, Jan. 10, 1993, 1 page.
Chancellor, N., "It's a Shoulder Style," The Sydney Morning Herald, <<https://www.newspapers.com/image/123869066>>, Jun. 24, 1947, 1 page.
Constance, M., "Backpacking the Baby," The Sydney Morning Herald, <<https://www.newspapers.com/image/120542968>>, Dec. 1, 1988, 1 page.
Gebrauchsanweisung (User's Manual), Weego Baby Carrier, 4 pgs.
"Why Choose the Wilkinet?," <<http://www.wilkinet.co.uk/WhyChoose.asp>>, Apr. 17, 2003, 2 pgs.
Wilkinet—FAQ, <<http://www.wilkinet.co.uk/FAQs.asp>>, Feb. 17, 2003, 3 pgs.
Wilkinet—History of the Wilkinet Baby Carrier, <<http://www.wilkinet.co.uk/History.asp>>, Feb. 17, 2003, 3 pgs.
Wilkinet—Reviews and Testimonials, <<http://www.wilkinet.co.uk/ReviewsParents.asp>>, Feb. 18, 2003, 2 pgs.
Wilkinet—Reviews and Testimonials, <<http://www.wilkinet.co.uk/ReviewsPress.asp>>, Feb. 18, 2003, 2 pgs.
Wilkinet—Product Views, <<http://www.wilkinet.co.uk/BabyCarriers.asp>>, Feb. 17, 2003, 2 pgs.
Wilkinet—Instructional Videos, <<http://www.wilkinet.co.uk/Videos.asp>>, Feb. 18, 2003, 2 pgs.
Appendix A: Baby Matey Non-Patent Literature as Cited on the Face of U.S. Pat. No. 4,986,458 ("Baby Matey Literature") Invalidity Chart, *The Ergo Baby Carrier, Inc.* v. *BOBA Inc.*, Case No. 2:15-cv-08946, In the United States District Court for the Central District of California, Jul. 15, 2016, 21 pgs.
Appendix BB: Consumer Reports Guide to Baby Products by Sandy Jones, published in 2001 ("Guide to Baby Products") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix AAA: Japanese Pub. No. S54-108131 ("The '131 Patent") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix B: Baby Matey System Invalidity Chart, *The Ergo Baby Carrier, Inc.* v. *BOBA Inc.*, Case No. 2:15-cv-08946, In the United States District Court for the Central District of California, Jul. 15, 2016, 22 pgs.
Appendix BB: U.S. Pat. No. 3,780,919 ("Hansson") Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix BBB: UK Patent App. No. GB 2026848 ("David") Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix C: Canadian Patent No. 1332928 ("Pettersen") Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix CC: "Physiological Strain Due to Load Carrying" by Michael Holewijn, published in European Journal of Applied Physiology and Occupational Physiology, Feb. 1990 ("Holewijn") Invalidity Chart, *The Ergo Baby Carrier, Inc.* v. *BOBA Inc.*, Case No. 2:15-cv-08946, In the United States District Court for the Central District of California, Jul. 15, 2016, 12 pgs.
Appendix CCC: DIY Baby Sling System Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix D: babyTrekker Instruction Manual copyright date stamped 1998 ("1998 babyTrekker Manual") Invalidity Chart, *The Ergo*

(56) References Cited

OTHER PUBLICATIONS

*Baby Carrier, Inc.* v. *BOBA Inc.*, Case No. 2:15-cv-08946, In the United States District Court for the Central District of California, Jul. 15, 2016, 19 pgs.
Appendix DD: Kelty Kangaroo Invalidity Chart, *The Ergo Baby Carrier, Inc.* v. *BOBA Inc.*, Case No. 2:15-cv-08946, In the United States District Court for the Central District of California, Jul. 15, 2016, 7 pgs.
Appendix DDD: Kozy System Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix E: babyTrekker Instruction Manual ("babyTrekker Manual") Invalidity Chart, *The Ergo Baby Carrier, Inc.* v. *BOBA Inc.*, Case No. 2:15-cv-08946, In the United States District Court for the Central District of California, Jul. 15, 2016, 21 pgs.
Appendix EE: Kirkiliones Invalidity Chart, *The Ergo Baby Carrier, Inc.* v. *BOBA Inc.*, Case No. 2:15-cv-08946, In the United States District Court for the Central District of California, Jul. 15, 2016, 9 pgs.
Appendix EEE: Packababy System Invalidity Chart, *The Ergo Baby Carrier, Inc.* v. *BOBA Inc.*, Case No. 2:15-cv-08946, In the United States District Court for the Central District of California, Jul. 15, 2016, 17 pgs.
Appendix F: babyTrekker System Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix FF: "Physicological, Biomechanical and Medical Aspects of Soldier Load Carriage" by Joseph Knapik, Presented in Jun. 2000 ("Knapik") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix FFF: Sakara System Invalidity Chart, *The Ergo Baby Carrier, Inc.* v. *BOBA Inc.*, Case No. 2:15-cv-08946, In the United States District Court for the Central District of California, Jul. 15, 2016, 17 pgs.
Appendix G: First Journey System Invalidity Chart, *The Ergo Baby Carrier, Inc.* v. *BOBA Inc.*, Case No. 2:15-cv-08946, In the United States District Court for the Central District of California, Jul. 15, 2016, 21 pgs.
Appendix GG: U.S. Pat. No. 4,434,920 ("Moore") Invalidity Chart, *The Ergo Baby Carrier, Inc.* v. *BOBA Inc.*, Case No. 2:15-cv-08946, In the United States District Court for the Central District of California, Jul. 15, 2016, 6 pgs.
Appendix GGG: Sutemi System Invalidity Chart, *The Ergo Baby Carrier, Inc.* v. *BOBA Inc.*, Case No. 2:15-cv-08946, In the United States District Court for the Central District of California, Jul. 15, 2016, 12 pgs.
Appendix H: French Patent Pub. No. 2795010 ("Ducruet") Invalidity Chart, *The Ergo Baby Carrier, Inc.* v. *BOBA Inc.*, Case No. 2:15-cv-08946, In the United States District Court for the Central District of California, Jul. 15, 2016, 8 pgs.
Appendix HH: "A Static Biomechanical Load Carriage Model" by R.P. Pelot et al., Presented in Jun. 2000 ("Pelot") Invalidity Chart, *The Ergo Baby Carrier, Inc.* v. *BOBA Inc.*, Case No. 2:15-cv-08946, In the United States District Court for the Central District of California, Jul. 15, 2016, 13 pgs.
Appendix HHH: Casses Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix I: U.S. Pat. No. 4,986,458 ("Linday") Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix II: Pony Ride Invalidity Chart, *The Ergo Baby Carrier, Inc.* v. *BOBA Inc.*, Case No. 2:15-cv-08946, In the United States District Court for the Central District of California, Jul. 15, 2016, 7 pgs.
Appendix III: U.S. Pat. No. 6,182,873 ("Christopher") Invalidity Chart, *The Ergo Baby Carrier, Inc.* v. *BOBA Inc.*, Case No. 2:15-cv-08946, In the United States District Court for the Central District of California, Jul. 15, 2016, 2 pgs.
Appendix J: U.S. Pat. No. 4,469,259 ("Krich") Invalidity Chart, *The Ergo Baby Carrier, Inc.* v. *BOBA Inc.*, Case No. 2:15-cv-08946, In the United States District Court for the Central District of California, Jul. 15, 2016, 8 pgs.
Appendix JJ: U.S. Pat. No. 5,114,059 ("Thatcher") Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix JJJ: U.S. Pat. No. 6,155,579 ("Eyman") Invalidity Chart, *The Ergo Baby Carrier, Inc.* v. *BOBA Inc.*, Case No. 2:15-cv-08946, In the United States District Court for the Central District of California, Jul. 15, 2016, 2 pgs.
Appendix K: "A Blue-Jean Person Pack," by E.A. Byrnes as published on p. 164 of the May/Jun. 1982 issue of The Mother Earth News ("Byrnes") Invalidity Chart, *The Ergo Baby Carrier, Inc.* v. *BOBA Inc.*, Case No. 2:15-cv-08946, In the United States District Court for the Central District of California, Jul. 15, 2016, 21 pgs.
Appendix KK: Weego System Invalidity Chart, *The Ergo Baby Carrier, Inc.* v. *BOBA Inc.*, Case No. 2:15-cv-08946, In the United States District Court for the Central District of California, Jul. 15, 2016, 20 pgs.
Appendix KKK: U.S. Pat. No. 5,848,741 ("Fair") Invalidity Chart, *The Ergo Baby Carrier, Inc.* v. *BOBA Inc.*, Case No. 2:15-cv-08946, In the United States District Court for the Central District of California, Jul. 15, 2016, 2 pgs.
Appendix L: EP Patent No. 0437365 ("Gunderman") Invalidity Chart, *The Ergo Baby Carrier, Inc.* v. *BOBA Inc.*, Case No. 2:15-cv-08946, In the United States District Court for the Central District of California, Jul. 15, 2016, 14 pgs.
Appendix LL: U.S. Pat. No. 6,257,468 ("Yamazoe") Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix LLL: Consumer Reports Guide to Baby Products by Sandy Jones, published in 2001 ("Guide to Baby Products") Invalidity Chart, *The Ergo Baby Carrier, Inc.* v. *BOBA Inc.*, Case No. 2:15-cv-08946, In the United States District Court for the Central District of California, Jul. 15, 2016, 8 pgs.
Appendix M: Kwik Sew Pattern No. 1046 ("Kwik Sew") Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix MM: Baby Matey Literature as Cited on the Face of U.S. Pat. No. 4,986,458 ("Baby Matey Literature") Invalidity Chart, *The Ergo Baby Carrier, Inc.* v. *BOBA Inc.*, Case No. 2:15-cv-08946, In the United States District Court for the Central District of California, Jul. 15, 2016, 20 pgs.
Appendix MMM: U.S. Pat. No. 3,780,919 ("Hansson") Invalidity Chart, *The Ergo Baby Carrier, Inc.* v. *BOBA Inc.*, Case No. 2:15-cv-08946, In the United States District Court for the Central District of California, Jul. 15, 2016, 2 pgs.
Appendix N: Japanese Pub. No. S53-155443 ("The '443 Patent") Invalidity Chart, *The Ergo Baby Carrier, Inc.* v. *BOBA Inc.*, Case No. 2:15-cv-08946, In the United States District Court for the Central District of California, Jul. 15, 2016, 12 pgs.
Appendix NN: Baby Matey System Invalidity Chart, *The Ergo Baby Carrier, Inc.* v. *BOBA Inc.*, Case No. 2:15-cv-08946, In the United States District Court for the Central District of California, Jul. 15, 2016, 22 pgs.
Appendix NNN: "Physiological Strain Due to Load Carrying" by Michael Holewijn, published in European Journal of Applied Physiology and Occupational Physiology, Feb. 1990 ("Holewijn") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix O: Japanese Patent Pub. No. S54-108131 ("The '131 Patent") Invalidity Chart, *The Ergo Baby Carrier, Inc.* v. *BOBA Inc.*, Case No. 2:15-cv-08946, In the United States District Court for the Central District of California, Jul. 15, 2016, 13 pgs.

(56) References Cited

OTHER PUBLICATIONS

Appendix OO: Canadian Patent No. 1332928 ("Pettersen") Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix OOO: Kelty Kangaroo Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix P: U.S. Pat. No. 4,009,808 ("Sharp") Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix PP: babyTrekker Instruction Manual copyright date stamped 1998 ("1998 babyTrekker Manual") Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix PPP: Kirkiliones Invalidity Chart, *The Ergo Baby Carrier, Inc.* v. *BOBA Inc.*, Case No. 2:15-cv-08946, In the United States District Court for the Central District of California, Jul. 15, 2016, 9 pgs.
Appendix Q: UK Patent App. No. GB 2026848 ("David") Invalidity Chart, *The Ergo Baby Carrier, Inc.* v. *BOBA Inc.*, Case No. 2:15-cv-08946, In the United States District Court for the Central District of California, Jul. 15, 2016, 8 pgs.
Appendix QQ: babyTrekker Instruction Manual ("babyTrekker Manual") Invalidity Chart, *The Ergo Baby Carrier, Inc.* v. *BOBA Inc.*, Case No. 2:15-cv-08946, In the United States District Court for the Central District of California, Jul. 15, 2016, 17 pgs.
Appendix QQQ: "Physiological, Biomechanical and Medical Aspects of Soldier Load Carriage" by Joseph Knapik, presented in Jun. 2000 ("Knapik") Invalidity Chart, *The Ergo Baby Carrier, Inc.* v. *BOBA Inc.*, Case No. 2:15-cv-08946, In the United States District Court for the Central District of California, Jul. 15, 2016, 10 pgs.
Appendix R: DIY Baby Sling System Invalidity Chart, *The Ergo Baby Carrier, Inc.* v. *BOBA Inc.*, Case No. 2:15-cv-08946, In the United States District Court for the Central District of California, Jul. 15, 2016, 13 pgs.
Appendix RR: babyTrekker System Invalidity Chart, *The Ergo Baby Carrier, Inc.* v. *BOBA Inc.*, Case No. 2:15-cv-08946, In the United States District Court for the Central District of California, Jul. 15, 2016, 14 pgs.
Appendix RRR: U.S. Pat. No. 4,434,920 ("Moore") Invalidity Chart, *The Ergo Baby Carrier, Inc.* v. *BOBA Inc.*, Case No. 2:15-cv-08946, In the United States District Court for the Central District of California, Jul. 15, 2016, 2 pgs.
Appendix S: Kozy System Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix SS: First Journey System Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix SSS: "A Static Biomechanical Load Carriage Model" by R.P. Pelot et al., Presented in Jun. 2000 ("Pelot") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix T: Packababy System Invalidity Chart, *The Ergo Baby Carrier, Inc.* v. *BOBA Inc.*, Case No. 2:15-cv-08946, In the United States District Court for the Central District of California, Jul. 15, 2016, 19 pgs.
Appendix TT: French Patent Pub. No. 2794010 ("Ducruet") Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix TTT: Pony Ride Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix U: Sakara System Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix UU: U.S. Pat. No. 4,986,458 ("Linday") Invalidity Chart, *The Ergo Baby Carrier, Inc.* v. *BOBA Inc.*, Case No. 2:15-cv-08946, In the United States District Court for the Central District of California, Jul. 15, 2016, 15 pgs.
Appendix UUU: U.S. Pat. No. 5,114,059 ("Thatcher") Invalidity Chart, *The Ergo Baby Carrier, Inc.* v. *BOBA Inc.*, Case No. 2:15-cv-08946, In the United States District Court for the Central District of California, Jul. 15, 2016, 3 pgs.
Appendix V: Sutemi System Invalidity Chart, *The Ergo Baby Carrier, Inc.* v. *BOBA Inc.*, Case No. 2:15-cv-08946, In the United States District Court for the Central District of California, Jul. 15, 2016, 14 pgs.
Appendix VV: U.S. Pat. No. 4,469,259 ("Krich") Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix VVV: Weego System Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix W: Casses Invalidity Chart, *The Ergo Baby Carrier, Inc.* v. *BOBA Inc.*, Case No. 2:15-cv-08946, In the United States District Court for the Central District of California, Jul. 15, 2016, 6 pgs.
Appendix WW: "A Blue-Jean Person Pack" by E.A. Byrnes as published on p. 164 of the May/Jun. 1982 issue of The Mother Earth News ("Byrnes") Invalidity Chart, *The Ergo Baby Carrier, Inc.* v. *BOBA Inc.*, Case No. 2:15-cv-08946, In the United States District Court for the Central District of California, Jul. 15, 2016, 17 pgs.
Appendix WWW: U.S. Pat. No. 6,257,468 ("Yamazoe") Invalidity Chart, *The Ergo Baby Carrier, Inc.* v. *BOBA Inc.*, Case No. 2:15-cv-08946, In the United States District Court for the Central District of California, Jul. 15, 2016, 2 pgs.
Appendix X: U.S. Pat. No. 6,182,873 ("Christopher") Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix XX: EP Patent No. 0437365 ("Gunderman") Invalidity Chart, *The Ergo Baby Carrier, Inc.* v. *BOBA Inc.*, Case No. 2:15-cv-08946, In the United States District Court for the Central District of California, Jul. 15, 2016, 14 pgs.
Appendix Y: U.S. Pat. No. 6,155,579 ("Eyman") Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix YY: Kwik Sew Pattern No. 1046 ("Kwik Sew") Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix Z: U.S. Pat. No. 5,848,741 ("Fair") Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix 77: Japanese Patent Publication No. S53-155443 ("The '443 Patent") Invalidity Chart, *The Ergo Baby Carrier, Inc.* v. *BOBA Inc.*, Case No. 2:15-cv-08946, In the United States District Court for the Central District of California, Jul. 15, 2016, 10 pgs.
Tentative Ruling on Claim Construction, U.S. Pat. Nos. 8,590,757 and 9,022,260, *The Ergo Baby Carrier, Inc.* v. *BOBA Inc.*, Case No. 2:15-cv-08946, In the United States District Court for the Central District of California, Dec. 1, 2016, 11 pgs.
File History for U.S. Trademark Application No. 75/457,187, filed Mar. 25, 1998, 56 pgs.
"Kinderpack Wearing Instructions for Infant Size," <<https://mykinderpack.com/pages/instructions>>, Copyright 2017 Kindercarry, 5 pgs.

(56) References Cited

OTHER PUBLICATIONS

"Kinderpack Wearing Instructions for Toddler Size," <<https://mykinderpack.com/pages/instructions>>, Copyright 2017 Kindercarry, 5 pgs.
SSC Instructions, <<http://www.isara.ro/en/content/7-instructiuni-ssc>>, Copyright 2016 ISARA, 12 pgs.
Wrapping instructions Baby Carriers, <<http://www.kokadi.de/en/instruction:_:162.html>>, Copyright 2016 ISARA, 28 pgs.
"The Five Hidden Features of the Yemaya Baby Carrier," <<http://http://blog.cybex-online.com/blog/safety/the-five-hidden-features-of-the-yemaya-baby-carrier/>>, Oct. 13, 2016 ISARA, 7 pgs.
Preliminary Invalidity Contentions, *The Ergo Baby Carrier, Inc.* v. *BOBA Inc.*, Case No. 2:15-cv-08946, In the United States District Court for the Central District of California, Jul. 15, 2016, 18 pgs.
BOBA, Inc.'s First Amended Counterclaims for Declaration of Unenforceability, Invalidity, and Monopolization, *The Ergo Baby Carrier, Inc.* v. *BOBA Inc.*, Case No. 2:15-cv-08946, In the United States District Court for the Central District of California, May 23, 2016, 73 pgs.
Joint Motion to Terminate for Inter Partes Review of U.S. Pat. No. 9,022,260 (IPR2016-01870) and U.S. Pat. No. 8590757 (IPR2016-01866), 3 pgs.
Office Action (with English translation) for Japanese Patent Application No. 2016-502118, dated Apr. 7, 2017, 9 pgs.
Office Action for U.S. Appl. No. 15/177,114, dated May 31, 2017, 12 pgs.
Office Action for U.S. Appl. No. 15/602,744, dated Aug. 8, 2017, 42 pgs.
Office Action (with English translation) for Korean Patent Application No. 10-2015-7028949, dated Jul. 20, 2017, 20 pgs.
Office Action for European Patent Application No. 14773586.4, dated Oct. 12, 2017, 5 pgs.
Office Action for Chinese Patent Application No. 201480023993.2, dated Sep. 26, 2017, 3 pgs.
Office Action for U.S. Appl. No. 15/177,114, dated Nov. 3, 2017, 12 pgs.
Office Action for U.S. Appl. No. 15/177,114, dated Feb. 21, 2018, 13 pgs.
Office Action for U.S. Appl. No. 15/916,990, dated May 15, 2018, 5 pgs.
Office Action for U.S. Appl. No. 15/337,813, dated May 22, 2018, 6 pgs.
Office Action for U.S. Appl. No. 15/177,114, dated May 30, 2018, 5 pgs.
International Preliminary Report on Patentability and Written Opinion for PCT/US2016/59534, dated May 1, 2018, 6 pgs.
Office Action for U.S. Appl. No. 15/094,515, dated Jun. 28, 2018, 15 pgs.
European Search Report for European Patent Application No. 16777348.0, dated Oct. 4, 2018, 10 pgs.
Office Action for U.S. Appl. No. 16/204,581, dated Jan. 25, 2019, 5 pgs.
International Search Report and Written Opinion for International Patent Application No. PCT/US17/58820, dated Jan. 5, 2018, 12 pgs.
Office Action for U.S. Appl. No. 15/796,422, dated Nov. 26, 2018, 18 pgs.
Office Action for U.S. Appl. No. 15/094,515, dated Feb. 19, 2019, 15 pgs.
Office Action for Japanese Patent Application No. 2017-552901 (with English translation), dated Feb. 19, 2019, 9 pgs.
International Preliminary Report on Patentability (IPRP) for International Application No. PCT/US2017/058820, dated May 9, 2019, 11 pgs.
Extended European Search Report for European Patent Application No. 16860977.4, dated Jun. 5, 2019, 7 pgs.
Office Action (with English translation) for Japanese Patent Application No. 2018-521974, dated Oct. 24, 2019, 7 pgs.
Office Action for U.S. Appl. No. 15/796,422, dated Nov. 21, 2019, 20 pgs.
Office Action (with English translation) for Korean Patent Application No. 10-2018-7015023, dated Dec. 17, 2019, 10 pgs.
International Search Report and Written Opinion for International Patent Application No. PCT/US19/063052, 11 pgs.
Office Action for U.S. Appl. No. 16/551,286, dated Apr. 23, 2020, 6 pgs.
Notice of Allowance (with English translation) for Korean Patent Application No. 10-2018-7015023, dated Jul. 9, 2020, 10 pgs.
Extended European Search Report for European Patent Application No. 17864576.8, dated Feb. 14, 2020, 7 pgs.
Initial Determination on Violation of Section 337 And Recommended Determination on Remedy and Bond, In re Matter of Certain Child Carriers, United States International Trade Commission, Inv. No. 337-TA-1154, Mar. 10, 2020, 210 pgs.
Exhibit RX-0116, In re Matter of Certain Child Carriers, United States International Trade Commission, Inv. No. 337-TA-1154, Photographs Embedded in McKibbon Declaration, Exhibit 3 to Depo of McKibbon, 2 pgs.
Exhibit RX-0118, In re Matter of Certain Child Carriers, United States International Trade Commission, Inv. No. 337-TA-1154, Photographs Embedded in McKibbon Declaration, Exhibit 4 to Depo of McKibbon, 1 pg.
Exhibit RX-0120, In re Matter of Certain Child Carriers, United States International Trade Commission, Inv. No. 337-TA-1154, Flickr Photos of Petals and Puddles, Exhibit 5 to Depo of McKibbon, 3 pgs.
Exhibit RX-0123, In re Matter of Certain Child Carriers, United States International Trade Commission, Inv. No. 337-TA-1154: Photo of carrier, Exhibit 7 to Depo of McKibbon, 1 pg.
Exhibit RX-0133, In re Matter of Certain Child Carriers, United States International Trade Commission, Inv. No. 337-TA-1154, Etsy Pages for petalsandpuddles, Exhibit 82 to Depo of Wick, 4 pgs.
Exhibit RX-0135, In re Matter of Certain Child Carriers, United States International Trade Commission, Inv. No. 337-TA-1154, Wayback Machine Page for Etsy search results baby sling, Exhibit 83 to Depo of Wick, Aug. 19, 2010, 4 pgs.
Exhibit RX-0159, In re Matter of Certain Child Carriers, United States International Trade Commission, Inv. No. 337-TA-1154, Ergobaby Omni 360 Cool Air Mesh Instruction Manual, 26 pgs.
Exhibit RX-0160, In re Matter of Certain Child Carriers, United States International Trade Commission, Inv. No. 337-TA-1154, Ergobaby Omni 360 Instruction Manual, 26 pgs.
Exhibit RX-0161, In re Matter of Certain Child Carriers, United States International Trade Commission, Inv. No. 337-TA-1154, Ergobaby Adapt Instruction Manual, 23 pgs.
Exhibit RX-0163, In re Matter of Certain Child Carriers, United States International Trade Commission, Inv. No. 337-TA-1154, Ergobaby 360 Bundle of Joy Instruction Manual, 26 pgs.
Exhibit RX-0200, In re Matter of Certain Child Carriers, United States International Trade Commission, Inv. No. 337-TA-1154, Declaration of Di Linh Reichman Regarding the Hibiscus Carrier, Sep. 2, 2019, 6 pgs.
Exhibit RX-0206, In re Matter of Certain Child Carriers, United States International Trade Commission, Inv. No. 337-TA-1154, Color Photograph (Respondent Exhibit), Exhibit 301 to Depo of Reichman, 1 pg.
Exhibit RX-0208, In re Matter of Certain Child Carriers, United States International Trade Commission, Inv. No. 337-TA-1154, Color Photograph (Respondent Exhibit), Exhibit 302 to Depo of Reichman, 1 pg.
Exhibit RX-0210, In re Matter of Certain Child Carriers, United States International Trade Commission, Inv. No. 337-TA-1154, Color Photograph (Respondent Exhibit), Exhibit 303 to Depo of Reichman, 1 pg.
Exhibit RX-0212, In re Matter of Certain Child Carriers, United States, International Trade Commission, Inv. No. 337-TA-1154, Color Photograph (Respondent Exhibit), Exhibit 304 to Depo of Reichman, 1 pg.
Exhibit RX-0214, In re Matter of Certain Child Carriers, United States International Trade Commission, Inv. No. 337-TA-1154, Color Photograph (Respondent Exhibit), Exhibit 305 to Depo of Reichman, 1 pg.

(56) References Cited

OTHER PUBLICATIONS

Exhibit RX-0216, In re Matter of Certain Child Carriers, United States International Trade Commission, Inv. No. 337-TA-1154, Color Photograph (Respondent Exhibit), Exhibit 306 to Depo of Reichman, 1 pg.
Exhibit RX-0218, In re Matter of Certain Child Carriers, United States International Trade Commission, Inv. No. 337-TA-1154, Color Photograph (Respondent Exhibit), Exhibit 307 to Depo of Reichman, 1 pg.
Exhibit RX-0231, In re Matter of Certain Child Carriers, United States International Trade Commission, Inv. No. 337-TA-1154, Declaration of Kristin Dybvig-Pawelko regarding the No Tie Mei Tai Hibiscus Child Carrier Exhibit 7 to Depo of Dr. Dybwig-Pawelko, Sep. 28, 2019, 9 pgs.
Exhibit RX-0235, In re Matter of Certain Child Carriers, United States International Trade Commission, Inv. No. 337-TA-1154, Color Photograph labeled A (Respondent Exhibit), Exhibit 320 to Depo of Dr. Dybwig-Pawelko, 1 pg.
Exhibit RX-0237, In re Matter of Certain Child Carriers, United States International Trade Commission, Inv. No. 337-TA-1154, Color Photograph labeled B (Respondent Exhibit), Exhibit 320 to Depo of Dr. Dybwig-Pawelko, 1 pg.
Exhibit RX-0239, In re Matter of Certain Child Carriers, United States International Trade Commission, Inv. No. 337-TA-1154, Color Photograph labeled C (Respondent Exhibit), Exhibit 320 to Depo of Dr. Dybwig-Pawelko, 1 pg.
Exhibit RX-0240, In re Matter of Certain Child Carriers, United States International Trade Commission, Inv. No. 337-TA-1154, Color Photograph labeled D (Respondent Exhibit), Exhibit 320 to Depo of Dr. Dybwig-Pawelko, 1 pg.
Exhibit RX-0241, In re Matter of Certain Child Carriers, United States International Trade Commission, Inv. No. 337-TA-1154, Omni Alternate Preliminary—For Review Only (PowerPoint) 10 pgs.
Exhibit RX-0242, In re Matter of Certain Child Carriers, United States International Trade Commission, Inv. No. 337-TA-1154, Color Photograph labeled E (Respondent Exhibit), Exhibit 320 to Depo of Dr. Dybwig-Pawelko, 1 pg.
Exhibit RX-0280, In re Matter of Certain Child Carriers, United States International Trade Commission, Inv. No. 337-TA-1154, TheBabyWearer post about carriers for facing out and referencing both Silly Goose and Pikkolo, Oct. 22, 2007, 9 pgs.
Exhibit RX-0289, In re Matter of Certain Child Carriers, United States International Trade Commission, Inv. No. 337-TA-1154, Pikkolo physical carrier and packaging, 12 pgs.
Exhibit RX-0296, In re Matter of Certain Child Carriers, United States International Trade Commission, Inv. No. 337-TA-1154, Tula Free-to-Grow Carrier Instruction Manual, 25 pgs.
Exhibit RX-0297, In re Matter of Certain Child Carriers, United States International Trade Commission, Inv. No. 337-TA-1154, Tula Explore Carrier Instruction Manual, 8 pgs.
Exhibit RX-0341, In re Matter of Certain Child Carriers, United States International Trade Commission, Inv. No. 337-TA-1154, Infantino Flip 4-in-1 Carrier Design Drawings, Sep. 21, 2017, 12 pgs.
Exhibit RX-0342, In re Matter of Certain Child Carriers, United States International Trade Commission, Inv. No. 337-TA-1154, Infantino Flip 4-in-1 Carrier Product Manual, 2 pgs.
Exhibit RX-0343, In re Matter of Certain Child Carriers, United States International Trade Commission, Inv. No. 337-TA-1154, Infantino Upscale Carrier Product Manual, 2016, 10 pgs.
Exhibit RX-0344, In re Matter of Certain Child Carriers, United States International Trade Commission, Inv. No. 337-TA-1154, Infantino Upscale Carrier Product Manual RX, 2016, 10 pgs.
Exhibit RX-0347, In re Matter of Certain Child Carriers, United States International Trade Commission, Inv. No. 337-TA-1154, Infantino Go Forward Evolved Product Manual, 24 pgs.
Exhibit RX-0351, In re Matter of Certain Child Carriers, United States International Trade Commission, Inv. No. 337-TA-1154, Photograph of Michelle McEntire and Children, Feb. 17, 2008, 1 pg.
Exhibit RX-0402, In re Matter of Certain Child Carriers, United States International Trade Commission, Inv. No. 337-TA-1154, Web Archive Hibiscus Baby Wearing Instructions, 2007, 3 pgs.
Exhibit RX-0411, In re Matter of Certain Child Carriers, United States International Trade Commission, Inv. No. 337-TA-1154, The Cat Bird Baby Website Printout—Our Booth at the ABC Kids Expo in Las Vegas, Sep. 13, 2007, 5 pgs.
Exhibit RX-0413, In re Matter of Certain Child Carriers, United States International Trade Commission, Inv. No. 337-TA-1154, The Cat Bird Baby Website Printout—Pikkolo, a Mei Tai-Like Buckle Carrier, Aug. 2, 2007, 5 pgs.
Exhibit RX-0415, In re Matter of Certain Child Carriers, United States International Trade Commission, Inv. No. 337-TA-1154, Pikkolo Carrier Design Drawings, Jul. 2007, 1 pg.
Exhibit RX-0417, In re Matter of Certain Child Carriers, United States International Trade Commission, Inv. No. 337-TA-1154, Cat Bird Baby Purchase Order, Sep. 25, 2007, 1 pg.
Exhibit RX-0419, In re Matter of Certain Child Carriers, United States International Trade Commission, Inv. No. 337-TA-1154, Sales Receipt for Pikkolo Carrier, Sep. 14, 2007, 4 pgs.
Exhibit RX-0437, In re Matter of Certain Child Carriers, United States International Trade Commission, Inv. No. 337-TA-1154, FlickR Page Printout, Sep. 19, 2008, 2 pgs.
Exhibit RX-0480, In re Matter of Certain Child Carriers, United States International Trade Commission, Inv. No. 337-TA-1154, FlickR Photograph of Closet with Different Types of Material, Apr. 30, 2008, 3 pgs.
Exhibit RX-0482, In re Matter of Certain Child Carriers, United States International Trade Commission, Inv. No. 337-TA-1154, FlickR Photograph of Closet with Different Types of Material, Apr. 30, 2008, 2 pgs.
Exhibit RX-0484, In re Matter of Certain Child Carriers, United States International Trade Commission, Inv. No. 337-TA-1154, FlickR Photograph of crafting supplies, Apr. 30, 2008, 2 pgs.
Exhibit RX-0504, In re Matter of Certain Child Carriers, United States International Trade Commission, Inv. No. 337-TA-1154, Exhibit A to Declaration of Joline Sikora, Jul. 10, 2007, 1 pg.
Exhibit RX-0505, In re Matter of Certain Child Carriers, United States International Trade Commission, Inv. No. 337-TA-1154, Exhibit B to Declaration of Joline Sikora, Jul. 11, 2007, 3 pgs.
Exhibit RX-0506, In re Matter of Certain Child Carriers, United States International Trade Commission, Inv. No. 337-TA-1154, Exhibit C to Declaration of Joline Sikora, Jul. 11, 2007, 3 pgs.
Exhibit RX-0507, In re Matter of Certain Child Carriers, United States International Trade Commission, Inv. No. 337-TA-1154, Exhibit D to Declaration of Joline Sikora, Sep. 18, 2007, 1 pg.
Exhibit RX-0508, In re Matter of Certain Child Carriers, United States International Trade Commission, Inv. No. 337-TA-1154, Exhibit E to Declaration of Joline Sikora, Sep. 18, 2007, 1 pg.
Exhibit RX-0509, In re Matter of Certain Child Carriers, United States International Trade Commission, Inv. No. 337-TA-1154, Exhibit F to Declaration of Joline Sikora, Sep. 18, 2007, 1 pg.
Exhibit RX-0510, In re Matter of Certain Child Carriers, United States International Trade Commission, Inv. No. 337-TA-1154, Exhibit G to Declaration of Joline Sikora, Sep. 18, 2007, 1 pg.
Exhibit RX-0512, In re Matter of Certain Child Carriers, United States International Trade Commission, Inv. No. 337-TA-1154, Exhibit I to Declaration of Joline Sikora, 2007), 3 pgs.
Exhibit RX-0513, In re Matter of Certain Child Carriers, United States International Trade Commission, Inv. No. 337-TA-1154, Exhibit J to Declaration of Joline Sikora, 1 pg.
Exhibit RX-0514, In re Matter of Certain Child Carriers, United States International Trade Commission, Inv. No. 337-TA-1154, Exhibit K to Declaration of Joline Sikora, 2007, 1 pg.
Exhibit RX-0515, In re Matter of Certain Child Carriers, United States International Trade Commission, Inv. No. 337-TA-1154, Exhibit L to Declaration of Joline Sikora, Feb. 17, 2008, 4 pgs.
Exhibit RX-0520, In re Matter of Certain Child Carriers, United States International Trade Commission, Inv. No. 337-TA-1154, Exhibit Q to Declaration of Joline Sikora, Aug. 23, 2007, 2 pgs.
Exhibit RX-0521, In re Matter of Certain Child Carriers, United States International Trade Commission, Inv. No. 337-TA-1154, Exhibit R to Declaration of Joline Sikora, Aug. 23, 2007, 2 pgs.

(56) References Cited

OTHER PUBLICATIONS

Exhibit RX-0522, In re Matter of Certain Child Carriers, United States International Trade Commission, Inv. No. 337-TA-1154, Exhibit S to Declaration of Joline Sikora, Feb. 17, 2008, 2 pgs.
Exhibit RX-0523, In re Matter of Certain Child Carriers, United States International Trade Commission, Inv. No. 337-TA-1154, Exhibit? to Declaration of Joline Sikora, Feb. 17, 2008, 2 pgs.
Exhibit RX-0524, In re Matter of Certain Child Carriers, United States International Trade Commission, Inv. No. 337-TA-1154, Exhibit U to Declaration of Joline Sikora, Feb. 17, 2008, 2 pgs.
Exhibit RX-0525, In re Matter of Certain Child Carriers, United States International Trade Commission, Inv. No. 337-TA-1154, Exhibit V to Declaration of Joline Sikora, Jul. 21,2007-Sep. 19, 2008, 64 pgs.
Exhibit RX-0526, In re Matter of Certain Child Carriers, United States International Trade Commission, Inv. No. 337-TA-1154, Exhibit W to Declaration of Joline Sikora, Feb. 27, 2007-Apr. 5, 2009, 41 pgs.
Exhibit RX-0527, In re Matter of Certain Child Carriers, United States International Trade Commission, Inv. No. 337-TA-1154, Exhibit A to Declaration of Mischele McEntire, Feb. 17, 2007, 2 pgs.
Exhibit RX-0528, In re Matter of Certain Child Carriers, United States International Trade Commission, Inv. No. 337-TA-1154, Exhibit B to Declaration of Mischele McEntire, Feb. 17, 2008, 4 pgs.
Exhibit RX-0539, In re Matter of Certain Child Carriers, United States International Trade Commission, Inv. No. 337-TA-1154, LILLEbaby Complete 6 Position Baby Carrier User Manual, Exhibit 613 to Depo of L. Lehan, 16 pgs.
Exhibit RX-0551, In re Matter of Certain Child Carriers, United States International Trade Commission, Inv. No. 337-TA-1154, Silly Goose Photos and thread from babywearer.com, Sep. 14, 2007, 14 pgs.
Exhibit RX-0552, In re Matter of Certain Child Carriers, United States International Trade Commission, Inv. No. 337-TA-1154, Silly Goose Photos and thread from babywearer.com, Oct. 31, 2007, 15 pgs.
Respondent's Pre-Hearing Brief, In re Matter of Certain Child Carriers, United States International Trade Commission, Inv. No. 337-TA-1154, Nov. 8, 2019, 405 pgs.
Respondent's Post-Hearing Initial Brief, In re Matter of Certain Child Carriers, United States International Trade Commission, Inv. No. 337-TA-1154, Jan. 6, 2020, 102 pgs.
Respondent's Post-Hearing Responsive Brief, In re Matter of Certain Child Carriers, United States International Trade Commission, Inv. No. 337-TA-1154, Jan. 28, 2020, 127 pgs.
Commission Investigative Staff's Pre-Hearing Brief, In re Matter of Certain Child Carriers, United States International Trade Commission, Inv. No. 337-TA-1154, Nov. 20, 2019, 195 pgs.
Commission Investigative Staff's Initial Post-Hearing Brief, In re Matter of Certain Child Carriers, United States International Trade Commission, Inv. No. 337-TA-1154, Jan. 13, 2020, 124 pgs.
Commission Investigative Staff's Reply Post-Hearing Brief, In re Matter of Certain Child Carriers, United States International Trade Commission, Inv. No. 337-TA-1154, Jan. 22, 2020, 26 pgs.
Complainant's Pre-Hearing Brief, In re Matter of Certain Child Carriers, United States International Trade Commission, Inv. No. 337-TA-1154, Nov. 21, 2019, 852 pgs.
Complainant's Post-Hearing Initial Brief, In re Matter of Certain Child Carriers, United States International Trade Commission, Inv. No. 337-TA-1154, Jan. 6, 2020, 147 pgs.
Complainant's Post-Hearing Responsive Brief, In re Matter of Certain Child Carriers, United States International Trade Commission, Inv. No. 337-TA-1154, Jan. 17, 2020, 85 pgs.
Notice of Commission Determination to Review in Part a Final Initial Determination Finding No Violation of Section 337; Termination of the Investigation, 85 Federal Register 95, at 29484-29485, May 15, 2020, 2 pgs.
Office Action for Japanese Patent Application No. 2018-521974 dated Aug. 14, 2020, 2 pgs.
Office Action (with English translation) for Korean Patent Application No. 10-2020-7029046, dated Oct. 22, 2020, 11 pgs.
Examination Report for European Patent Application No. 17864576.8, dated Nov. 16, 2020, 5 pgs.
Office Action for Japanese Patent Application No. 2020-060090, dated Feb. 19, 2021, 1 pg.
Office Action for U.S. Appl. No. 16/694,641, dated Mar. 17, 2021, 17 pgs.
Moriguchi Yuko, JP-2014176494A, Google translation, Sep. 2014, 14 pgs.
Office Action with English translation for Chinese Patent Application No. 201680071536.X, dated Apr. 7, 2021, 18 pgs.
International Preliminary Report on Patentability (Ch. 1) for International Application No. PCT/US2019/063052, dated May 25, 2021, 4 pgs.
Office Action with English translation for Korean Patent Application No. 10-2020-7029046, dated Jun. 2, 2021, 8 pgs.
Office Action with English translation for Japanese Patent Application No. 2019-523098, dated May 31, 2021, 13 pgs.
Notice of Allowance with English translation for Korean Patent Application No. 10-2020-7029046, dated Aug. 5, 2021, 8 pgs.
Office Action for U.S. Appl. No. 16/872,244, dated Aug. 25, 2021, 6 pgs.
Notice of Allowance for U.S. Appl. No. 16/694,641, dated Sep. 7, 2021, 2 pgs.
European Patent Office, Communication Under Rule 71(3) Intention to Grant Notice, dated Sep. 7, 2022, Application No. 21180405.9, International Filing date Jun. 18, 2021, Applicant: The Ergo Baby Carrier, Inc.
U.S. Appl. No. 18/196,539, filed May 12, 2023, Rodney V. Telford.
U.S. Appl. No. 18/202,058, filed May 25, 2023, Rodney V. Telford.
Nuna International B.V., Cudl Clik Instructions User Manual, www.nunababy.com
Najell Rise, Baby Carrier | 0-3 years | 3 Carrying Position, https://najell.com/p/najell-rise-jet-black
Infantino, Flip 4-in-1 Convertible Carrier Instruction Manual, 2018, www.info@Blue-box.com
Infantino, Flip 4-in-1 Convertible Carrier Instruction Manual, 2022, www.infantino.com
Lascal M1 Carrier User Manual, ASTM F2236-16a, EN13209-2:2015, US-80006 Ver13, www.lascal.net.
Meet Isara Quick Half Bucklet Carrier, https:// www.yumpu.com/en/document/read/63362302/issara-quick-half-buckle-carrier.
Apprica, Baby strap "Laclis Laclis", Baby Products Apprica Official Website Sep. 2023, https:// www.aprica.jp/products/sling/details/sling/laclis/, Japan.
Lucky Industries Co., Ltd., Lucky 1934 Lucky Fuwa Hug, Waist Belt Type, https://lucky-industries.jp/products/lucky1934-fuwa-hug/, Japan.
Lucky Industries Co., Ltd., Lucky1934 (Lucky 1934) fuwahug Fuwahug Baby Carrier Baby Strap L4620 (from 14 days old), https:// luckybabystore.jp/products/fuwahug 2023, Japan.
U.S. Appl. No. 17/572,084, Final Office Action dated Jul. 10, 2023.
U.S. Appl. No. 18/202,058, Non-Final Office Action dated Aug. 14, 2023.
Office Action for U.S. Appl. No. 15/177,114, dated Oct. 3, 2017, 5 pages.
Office Action issued for U.S. Appl. No. 15/117,114, dated Oct. 3, 2017, 5 pages.
Peekara Story, https://blog.naver.com/becocarrier/140212053895>, 2022.
Petition for Inter Partes Review of U.S. Pat. No. 8,590,757, 100 pgs.
Petition for Inter Partes Review of U.S. Pat. No. 9,022,260, 94 pgs.
File History for U.S. Trademark Application U.S. Appl. No. 75/457,187, filed Mar. 25, 1998, 76 pages.
Chinese Patent Application No. 201780075232.5, Office Action dated May 10, 2022.
Corrected Notice of Allowability for U.S. Appl. No. 15/796,422, dated May 30, 2019, 6 pgs.
Jones, Sandy, Back Packs and Soft Carriers, Guide to Baby Products, Consumers Digest, 1998, Ch. 4, pp. 33-40.

(56) References Cited

OTHER PUBLICATIONS

Korean Patent Application No. 10-2019-7015083, Notice of Allowance, dated Oct. 25, 2022.
KR Application No. 10-2019-7015083 Korean Office Action dated Apr. 28, 2022.
European Patent Application 21180405.9 Decision to Grant dated May 11, 2023.
European Patent Application 16860977.4 Office Action dated Mar. 22, 2023.
Notice of Allowance for U.S. Appl. No. 15/337,813, dated Feb. 14, 2019, 9 pgs.
Notice of Allowance for U.S. Appl. No. 15/337,813, dated Jul. 1, 2019, 2 pgs.
Notice of Allowance for U.S. Appl. No. 15/337,813, dated Nov. 5, 2018, 5 pgs.
Notice of Allowance for U.S. Appl. No. 15/796,422, dated Apr. 20, 2020, 7 pgs.
Notice of Allowance for U.S. Appl. No. 15/796,422, dated Jul. 25, 2019, 8 pgs.
Notice of Allowance for U.S. Appl. No. 15/796,422, dated Mar. 27, 2019, 8 pgs.
Notice of Allowance for U.S. Appl. No. 15/916,990, dated Aug. 25, 2018, 5 pgs.
Notice of Allowance for U.S. Appl. No. 15/916,990, dated Nov. 9, 2018, 5 pgs.
Notice of Allowance for U.S. Appl. No. 16/204,581, dated Aug. 19, 2019, 6 pgs.
Notice of Allowance for U.S. Appl. No. 16/204,581, dated Oct. 9, 2019, 6 pgs.
Notice of Allowance for U.S. Appl. No. 16/551,286, dated Aug. 18, 2020, 5 pgs.
Notice of Allowance for U.S. Appl. No. 16/551,286, dated Jan. 19, 2021, 5 pgs.
Notice of Allowance for U.S. Appl. No. 16/682,288, dated Apr. 26, 2021, 6 pgs.
Notice of Allowance for U.S. Appl. No. 16/682,288, dated Mar. 2, 2021, 6 pgs.
Notice of Allowance for U.S. Appl. No. 16/694,641, dated Sep. 7, 2021, 5 pgs.
Notice of Allowance issued for U.S. Appl. No. 15/170,629, dated Feb. 1, 2017, 7 pages.
Notice of Allowance issued for U.S. Appl. No. 15/170,629, dated Oct. 28, 2016, 5 pages.
Notice of Allowance issued for U.S. Appl. No. 15/602,744, dated Dec. 8, 2017, 5 pages.
Office Action (with English translation) for Chinese Patent Application No. 201680071536.X, dated Nov. 16, 2020, 16 pgs.

* cited by examiner

ADJUSTABLE CHILD CARRIER WITH MULTIPLE CARRY ORIENTATIONS

RELATED APPLICATIONS

This application claims the benefit of priority under 35 U.S.C. § 119(e) of U.S. Provisional Application No. 63/041,610 filed Jun. 19, 2020, entitled "Adjustable Child Carrier with Multiple Carry Orientations," which is hereby fully incorporated herein in its entirety for all purposes.

TECHNICAL FIELD

The present disclosure relates to child carriers. Even more particularly, the present disclosure relates to a child carrier that is adaptable to ergonomically carry a child as the child grows.

BACKGROUND

Various child carriers are currently available for transporting a child by a parent or other individual. Child carriers have become popular for carrying infants and toddlers because they afford the wearer freedom of hand and arm movement while carrying a child. In pursuit of child safety, some of these devices have become overly complex involving, among other things, rigid seats and frames which considerably increase the weight of the carrier and cannot accommodate for the growth of the child. These complex carriers are relatively heavy and place an undue strain upon the wearer, particularly in the lumbar region. In addition, because of the size of many of the present-day carriers, they can only be worn on the back thus denying the child the comfort and security of a position where a child and its mother may be in a face-to-face relationship.

Soft structured carriers have become increasingly popular because they are lighter, less cumbersome, and more comfortable to wear. These carriers incorporate padding, stitching and fabrics, rather than a rigid frame, to provide the structure. However, some soft-structured carriers hold a child in an upright position with the child's legs hanging down and the base of the child's spine supporting the child's body weight. This position may not be optimal for infants and other young children. While an adult spine has four curves, a young child's spine only has two curves. A majority of a young child's spine will form a C-shape (so-called total kyphosis). Positioning a young child, particularly an infant, in an upright position may unduly limit curvature of the spine and puts stress on the infant's sacrum. This can cause the infant's pelvis to tilt backward, limiting leg and hip movement, which may impede healthy development of the infant's pelvis.

Moreover, conventional soft structured carriers are usually designed for a very limited age, weight and size of child and make compromises regarding the shape of the carrier to accommodate a range of ages. Even if a carrier supports ergonomic positioning of the child at one age/weight/size, positioning a child in an ergonomic position through the range of ages while utilizing the same carrier poses a problem as different children develop at different rates and the anatomy and physiology of children changes dramatically between infancy and toddlerhood.

A carrier designed for infants or younger babies may not accommodate a child as the child grows into toddlerhood because the seat and back support portions of the carrier will become too small. In an attempt to make carriers more adaptable, some carriers provide additional panels that can be unfolded and added to the seat to widen the seat and/or back panels that can expand (e.g., by unfolding additional back panel material or attaching new panels) to accommodate the child's growth. However, simply widening the seat or lengthening the carrier does not adequately address proper ergonomics.

On the other hand, a carrier designed for older children may not properly support an infant. One solution to this problem is the use of a specially designed "infant insert." In general, an infant insert is an accessory that incorporates additional padding and structure and makes it possible to carry a small infant in a carrier that would not otherwise properly support the infant. However, not all carriers support the use of infant inserts. Moreover, depending on design, infant inserts may be cumbersome, non-intuitive, and easily lost. In particular, the use of a separate infant insert may require that parents keep track of two separate devices and may significantly increase the difficulty of configuring the carrier for a wearer, the wearing of the carrier, or the ingress and egress of a child to the carrier.

Furthermore, many carriers provide limited flexibility, only allowing the child to be properly oriented in a single orientation either facing the wearer or looking away from the wearer. Due to the foregoing issues, parents often opt for changing carriers as the child ages.

SUMMARY

The present disclosure relates to child carriers that allow a child, including an infant, to be carried in a manner that supports the child and maintains the child's pelvis and thighs in a preferred ergonomic position through a range of ages. According to one embodiment, the adjustable child carrier comprises a waist belt adapted for securing about a wearer's hips, a main body coupled to the waist belt, the main body adapted to form a child carrying area in cooperation with a wearer's torso, shoulder straps to lift the main body to form the child carrying area, a pair of side attachment tabs attached to the interior side of the main body away from the outer edges of the main body, the pair of side attachment tabs comprising lower attachment points for the shoulder straps, and a seat portion.

According to one embodiment, the seat portion comprises a seat center portion and a pair of thigh supports that cooperate with the seat center portion to form an adjustable bucket seat. The adjustable bucket seat can be configurable in a plurality of bucket seat configurations to accommodate a plurality of child sizes and carrying orientations. Each of the plurality of bucket seat configurations may have a corresponding bucket seat depth and bucket seat width and be adapted to support a child in a corresponding size range in a spread squat position.

The pair of thigh supports are adjustable to set a mid-section width of the adjustable child carrier and a base width of the adjustable bucket seat. According to one embodiment, the pair of thigh supports include a first thigh support having an upper end portion adapted to selectively couple to a first side attachment tab from the pair of side attachment tabs at a first set of mid-section width setting locations on the first side attachment tab and a lower end portion selectively couplable to the waist belt at a first set of base width setting locations. The pair of thigh supports also include a second thigh support. The second thigh support has an upper end portion that is selectively couplable to a second side attachment tab at a second set of mid-section width setting locations and a lower end portion selectively couplable to the waist belt at a second set of base width setting locations.

The thigh supports can be adjusted to adjust the base width and depth of the bucket seat and the mid-section width to provide a variety of seating configuration to ergonomically support a child as the child grows and to support both outward facing and inward facing orientations in some embodiments.

BRIEF DESCRIPTION OF THE DRAWINGS

For a better understanding of these and other objects of the invention, reference will be made to the following detailed description of the invention which is to be read in association with the accompanying drawings, wherein.

DETAILED DESCRIPTION

Figure 1A:
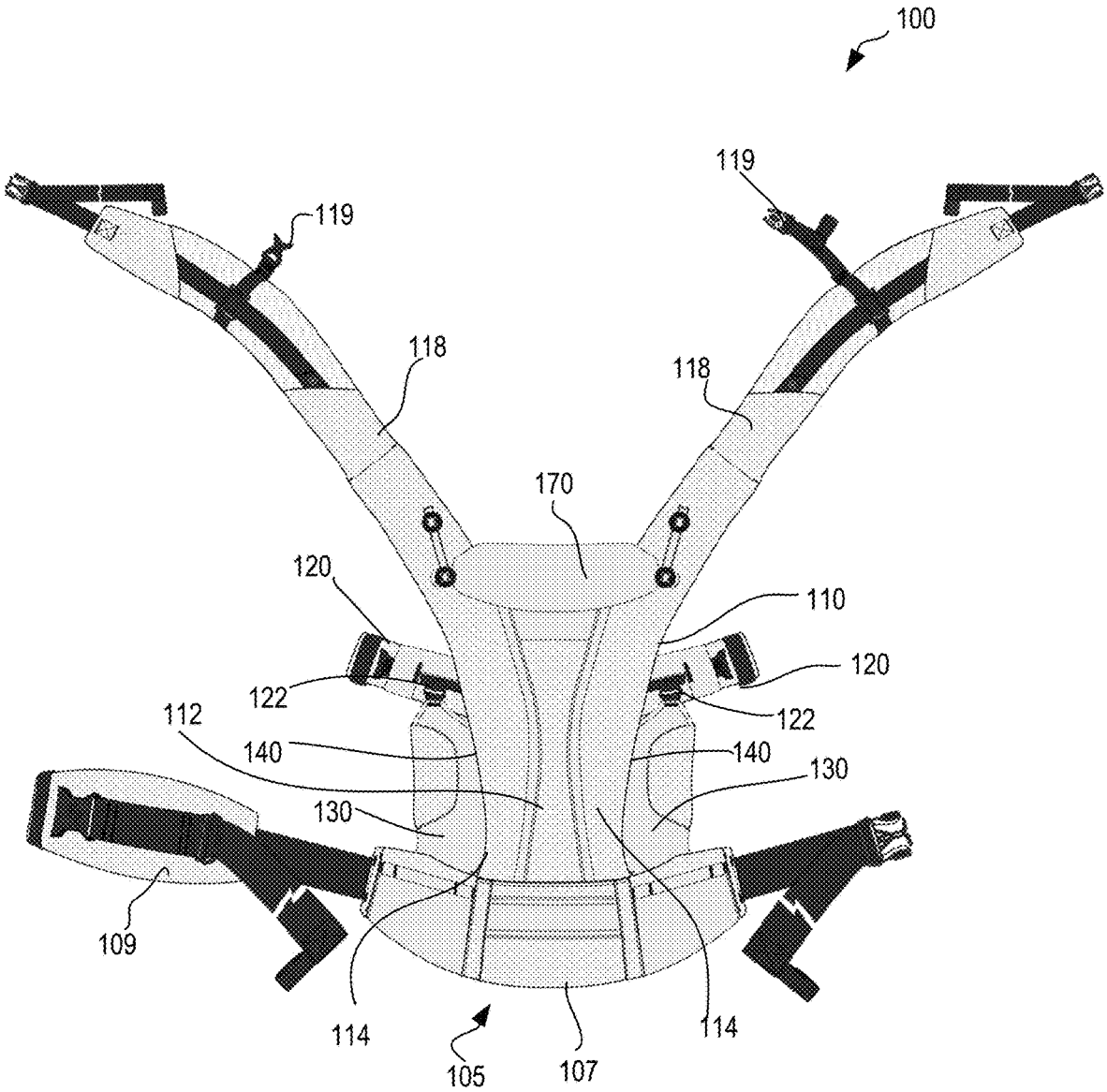
FIG. 1A illustrates a front view of one embodiment of an unfurled carrier.

Child carriers and related methods and the various features and advantageous details thereof are explained more fully with reference to the nonlimiting embodiments that are illustrated in the accompanying drawings and detailed in the following description. Descriptions of well-known starting materials, processing techniques, components and equipment are omitted so as not to unnecessarily obscure the invention in detail. It should be understood, however, that the detailed description and the specific examples, while indicating preferred embodiments of the invention, are given by way of illustration only and not by way of limitation. Various substitutions, modifications, additions and/or rearrangements within the spirit and/or scope of the underlying inventive concept will become apparent to those skilled in the art from this disclosure.

The present disclosure relates to child carriers that allow a child, including an infant, to be carried in a manner that supports the child and maintains the child's pelvis and thighs in a preferred ergonomic position through a range of ages. In particular, embodiments described herein provide carriers that support the child's bottom, pelvis and thighs in a desired position. Embodiments described herein also allow a child to be carried on the front or back or to the side of the person carrying the child. The carrier can be worn by a user in front of, in back of or to the side of the wearer with the child's weight carried near the wearer's center of gravity and close to the wearer's front, back or side in a front, back or side position, respectively. In addition, the child may be oriented in an inward facing orientation or outward facing orientation in at least one of the positions.

According to one embodiment, a child carrier includes a waist belt, one or more panels forming a torso support portion and a seat portion, and a set of shoulder straps. The torso support portion is adapted for supporting at least the torso of a child. The seat portion forms a bucket seat configurable in a plurality of bucket seat configurations, each of the plurality of bucket seat configurations having a different bucket seat depth and bucket seat width and adapted to support a child in a corresponding size range in a spread squat position. The plurality of bucket seat configurations includes configurations adapted to ergonomically support children in a range of sizes. For example, the plurality of bucket seat configurations may include configuration to ergonomically support children from infants to toddlers.

The child carrier includes adjustment points that work alone or in cooperation to adjust the shape of the bucket seat area provided by the child carrier. These adjustment points can be configured to adjust, without limitation, seat base width, a mid-section width, a seat depth, and carrier wearable height. According to one embodiment, the carrier includes a base width adjustment mechanism to adjust the base width of the seat portion where the seat portion is coupled to the waist belt of the carrier. Adjusting the base width of the seat portion may serve to provide maximum shape for the bucket area and thus maximum depth of the bucket seat area when adjusted to the narrowest setting suitable for smaller children (e.g., newborn babies) and the minimal depth of the bucket seat area for larger children (e.g., toddlers) when adjusted to the widest setting.

When the depth of the bucket seat is at a maximum, the child's thighs may be supported such that the angle of the thighs of the child relative to the coronal plane may be greatest and when the depth of the bucket seat is at a minimum the thighs may be supported such that the angle of the thighs of the child relative to the coronal plane may be the smallest. Similarly, when the bucket seat is at a maximum, the carrier may be configured such that the carrier maintains a child carried therein with relatively more curve in their spine than when the bucket seat is at a minimum depth.

The carrier of certain embodiments may also be configured to adjust in height. In certain embodiments, the length of the physical carrier from the top edge of the waist belt at the center to the top edge of carrier at the center remains consistent, however, the wearable height changes depending on the setting of the bucket seat size. With the base width at its smallest/narrowest setting the bucket seat is deeper consuming and the child is seated deeper in the carrier further away from the top edge of the waist band thus leaving less measurement for the wearable height, whereas with the base width at is largest/widest setting the bucket seat is shallow and the child is seated closer to the top edge of the waist belt, leaving more measurement for the wearable height.

The adjustable child carrier can be configured to accommodate children of a wide range of sizes in a front, rear or side carrying position while supporting the child's hips, pelvis, bottom and both upper thighs when the child is being carried in various orientations. For example, embodiments of a child carrier as disclosed herein may provide an adjustable child carrier usable with newborn children (infant) (e.g., around 7 pounds) and additionally with children all the way up to around 45 pounds or more. Embodiments may thus be sized appropriately to carry an infant without the use of an additional infant insert. Configured according to such a setting, the carrier may be adapted for placement of a child in a child carrying area of the child carrier with the infant's knees raised. In one embodiment, when adjusted to accommodate an infant the carrier is adapted to support the infant in a position with the infant's femur at an angle of 90-120 degrees from the coronal plane. Additionally, the carrier can be adapted to support the infant in a position with the infant's knees at 45-60 degrees from the median plane. In particular embodiments, the carrier can be adapted to promote a spread-squat-position.

According to another aspect, a child carrier is provided that allows a child to be carried in multiple orientations (e.g., inward facing and outward facing) in a manner that supports the child and maintains the child's pelvis and thighs in a preferred ergonomic position. To this end, embodiments may include an inward/outward facing adjustment mechanism to reconfigure the carrier from a configuration that is adapted for carrying the child in an outward facing orientation to a configuration that is adapted for carrying the child in an inward facing orientation. According to one embodiment, adjusting the inward/outward facing adjustment mechanism adjusts the width of the seat portion away from the waist belt and can serve to configure the carrier for carrying a child in an outward facing orientation or an inward facing orientation.

Some embodiments allow a child to be carried in an outward facing orientation (i.e., facing away from the person carrying the child) or an inward facing orientation (i.e., facing toward the person carrying the child), and further allow the child to be carried on the front or back or to the side of the person carrying the child. In particular, some embodiments support the child's bottom, pelvis and thighs in a desired position in both an outward facing orientation and an inward facing orientation. The carrier can be worn by a user in front of, in back of or to the side of the wearer with the child's weight carried near the wearer's center of gravity and close to the wearer's front, back or side in a front, back or side position, respectively.

Embodiments of such carriers may also include an adjustable neck support. Such a neck support or collar that may be positioned according to the direction the child is facing, the size of the child, or other criteria. The adjustable neck support may be rotatable relative to the torso support portion such that the neck support may be extended increasing the center height of the carrier giving additional back or neck support for a child (depending on the size of the child). The neck support may also be folded back away from the wearer to reduce the height of the carrier (e.g., for non-infant children). The neck support may also be folded down into the carrier toward the wearer such that it may reside inside the child carrying area to give an infant or other child additional head or neck support.

The carrier can be ergonomic for the wearer as well. A padded waist belt may provide lumbar support and may cooperate with shoulder straps (that may attach to the same or opposite sides of the carrier) that can form a configurable harness that can position the carrier in a front, side or back carry position while distributing the weight evenly to the wearer. The carrier may be adjusted such that the child is positioned close to the wearer's center of gravity which distributes the child's weight evenly. In some embodiments, the harness may be adjusted so that a majority of the child's weight is transferred to the wearer's hips.

Embodiments described herein provide an advantage over prior carriers because the ergonomic bucket seat gradually adjusts to a growing baby from newborn to toddler, to ensure the baby is seated in an ergonomic spread-squat, natural "M shape" position at multiple stages.

As an additional advantage, embodiments described herein can provide an adjustable seat shape that does not require adding to or removing structure from the carrier to change the seat shape. For example, some embodiments can accommodate infants and larger children without requiring an infant insert for an infant.

Embodiments described herein can provide another advantage by allowing the carrier seat shape to be easily adjusted without adding or removing panels from the seat.

Embodiments described herein can provide another advantage by providing a carrier with a wearable length that can be adjusted without requiring complicated mechanisms to extend the overall length of the carrier.

Embodiments described herein provide another advantage by allowing the same carrier to support both inward and outward facing orientations in at least one position.

Figure 1B:
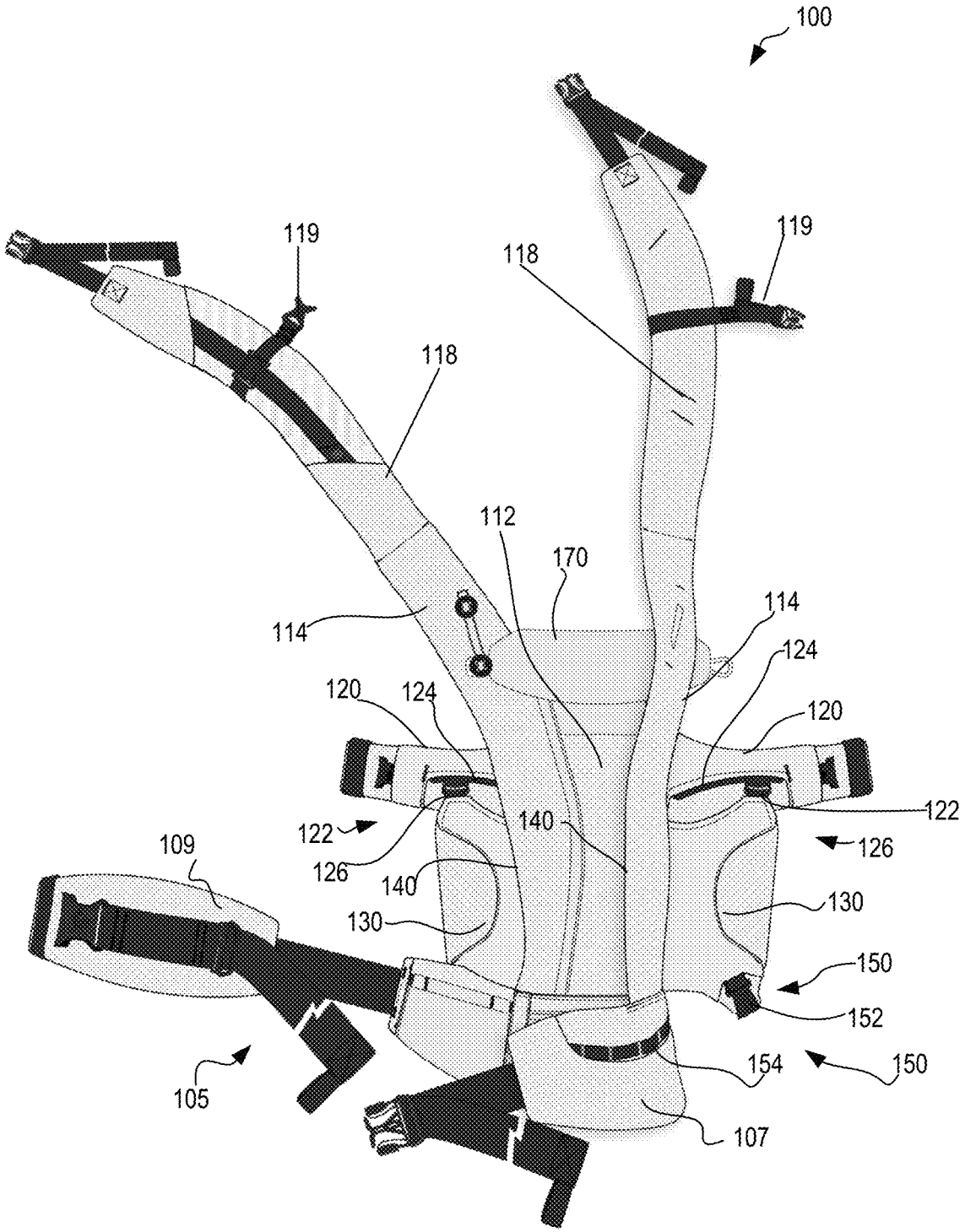
FIG. 1B illustrates a front view of one embodiment of an unfurled carrier with a portion of the carrier folded back.
Figure 1C:
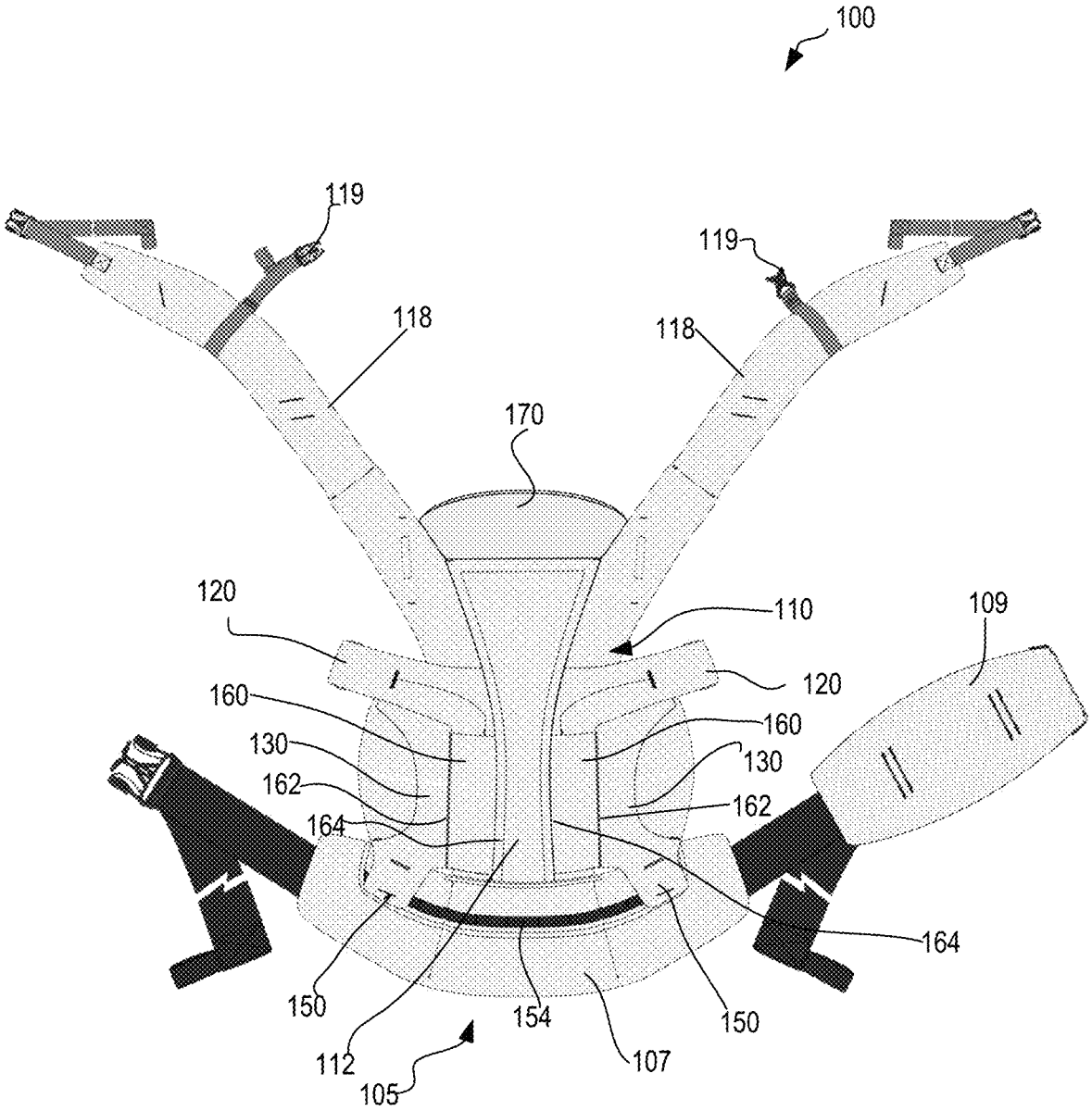
FIG. 1C illustrates a rear, inner side view of one embodiment of an unfurled carrier.
Figure 1D:
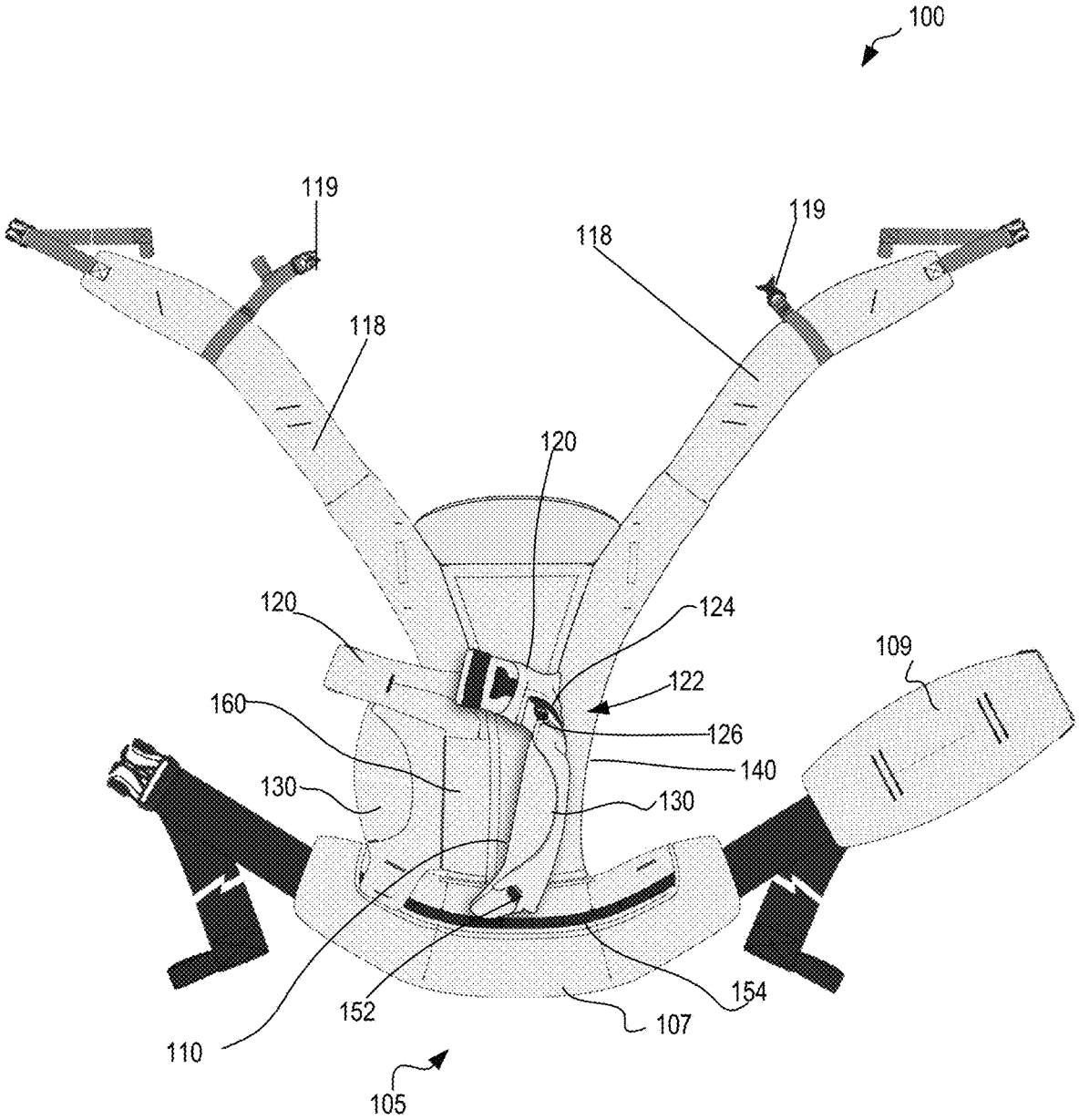
FIG. 1D illustrates a rear, inner side view of one embodiment of an unfurled carrier with a portion of the carrier folded back.
Figure 2:
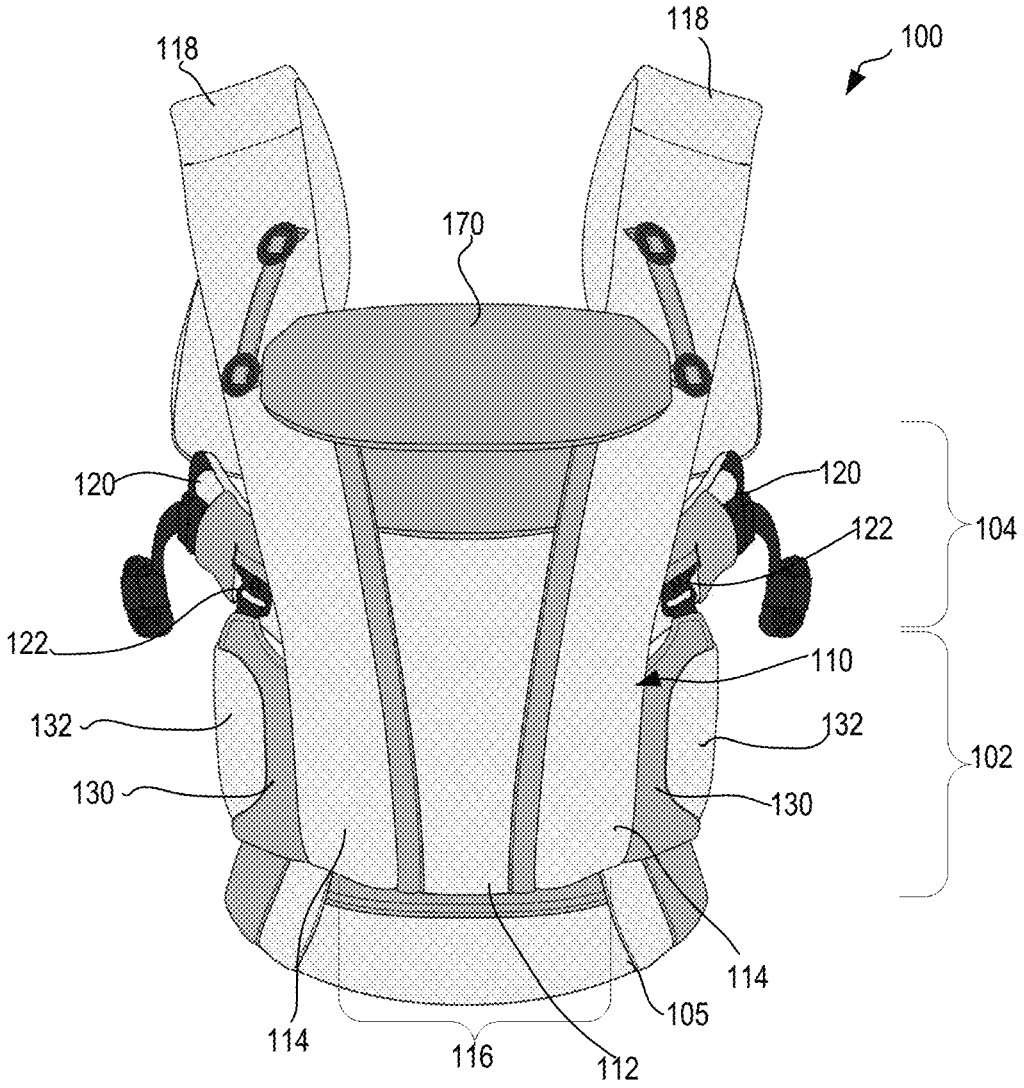
FIG. 2 illustrates a front view of one embodiment of a carrier.

FIG. 1A illustrates a front view of one embodiment of an adjustable child carrier 100 with carrier 100 with carrier 100 in an unfurled configuration, FIG. 1B illustrates a front view of one embodiment of carrier 100 in an unfurled configuration with a portion of the carrier folded back, FIG. 1C illustrates a rear, inner side view of one embodiment of carrier 100 in an unfurled configuration, FIG. 1D illustrates a rear, inner side view of one embodiment of carrier 100 in an unfurled with a portion of the carrier folded back. FIG. 2 illustrates one embodiment of a front view of child carrier 100 in one embodiment of a child-carrying configuration. Carrier 100 includes a seat portion 102 to support the child's bottom, pelvis and thighs and a torso support portion 104 to support the upper body of the child while in carrier 100.

Figure 3A:
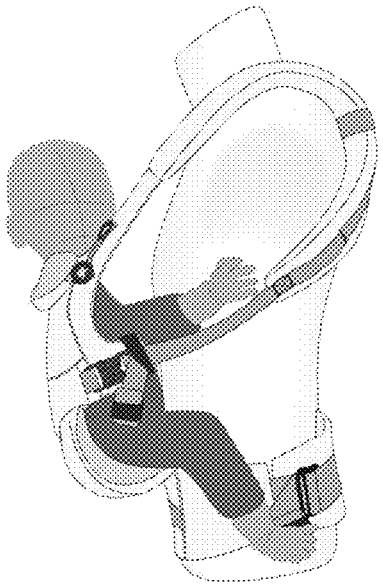
FIG. 3A illustrates one embodiment of a carrier being worn in a front carry, inward facing configuration.
Figure 3B:
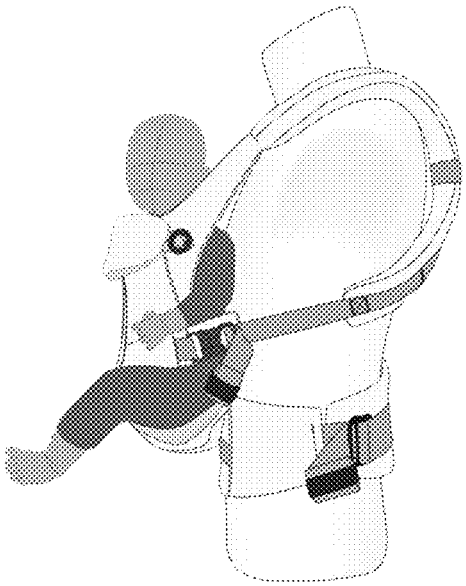
FIG. 3B illustrates one embodiment of a carrier being worn in a front carry, outward facing configuration.
Figure 3C:
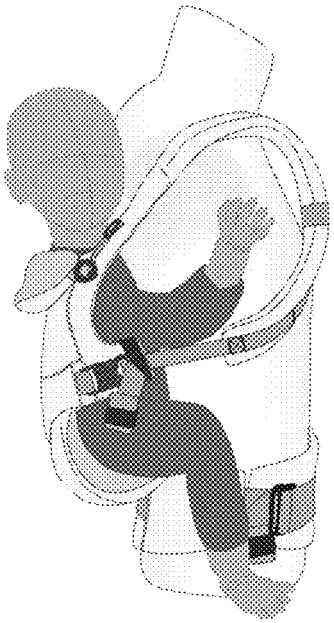
FIG. 3C illustrates one embodiment of a carrier being worn in a back carry, inward facing configuration.
Figure 3D:
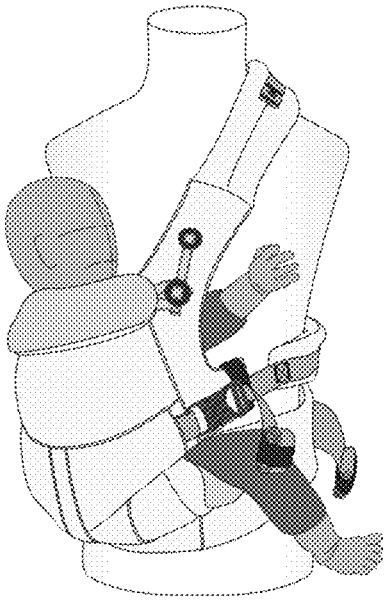
FIG. 3D illustrates one embodiment of a carrier being worn in a side carry configuration.

The adjustable carrier 100 may be worn in a variety of positions relative to the wearer and can ergonomically support a child in an inward facing orientation and an outward facing orientation. FIG. 3A, for example, is a side view of one embodiment of an adjustable child carrier worn in a front carry position with a child supported in an inward facing (facing away from the wearer) orientation. That is, the carrier is configured in a "front inward facing" configuration in FIG. 3A. FIG. 3B is a side view of one embodiment of an adjustable child carrier worn in a front carry position with a child supported in an outward facing (facing away from the wearer) orientation. That is, the carrier is configured in a "front outward facing" configuration in FIG. 3B. FIG. 3C is a diagrammatic representation of a side view of one embodiment of an adjustable child carrier worn in a back carry position with a child supported in an inward facing orientation (a "back inward facing" configuration). FIG. 3D is a diagrammatic representation of one embodiment of a child carrier in a side carry (or hip carry) position with a child supported in an inward facing orientation (a "side inward facing" configuration).

In the illustrated embodiment, carrier 100 includes waist belt 105, a main body 110 (e.g., a main panel), shoulder straps 118, side attachment tabs 120 (e.g., side shoulder strap attachment tabs), thigh supports 130 (e.g., thigh support tabs) and a neck support 170. A child can be supported in a child carrying area created by main body 110 of the carrier in cooperation with the wearer's torso with waist belt 105 and shoulder straps 118 providing a harness that distributes the child's weight to the wearer. Waist belt 105 may include various padded sections (e.g., padded section 107 and padded section 109) to distribute the child's weight to the wearer's hips or otherwise increase wearer comfort. The shoulder straps can be arranged in a variety of configurations depending on carrier position and wearer preference, including, but not limited to, a parallel strap configuration (FIG. 10A) and a cross-strap or "x" configuration (FIG. 10B). A cross strap 119 (chest/back strap) can be used to secure left and right shoulder straps together in certain configurations.

Carrier 100 may be constructed in a variety of ways. In the illustrated embodiment, main body 110 comprises a center panel 112 and side panels 114. The lower edges of the center panel 112 and side panels 114 of main body 110 are attached to waist belt 105. Thigh supports 130 and side attachment tabs 120 are attached to the inner side of main body 110 of the carrier away from the side edges 140 of main body 110. In the illustrated embodiment, thigh supports 130 and side attachment tabs 120 are attached proximate to the side edges of the center panel 122 and to the inner side of side panels 114. The upper end portions of thigh supports 130 can be selectively coupled to side attachment tabs 120 at multiple locations and the lower end portions of thigh supports 130 can be selectively coupled to waist belt 105 at multiple locations.

According to one embodiment, the first side attachment tab 120 attachment panel is attached to main body 110 to the first side of the lateral centerline of main body 110 and closer to the lateral centerline than to the first side edge 140 on that side of the lateral centerline and the second side attachment tab 120 is attached to main body 110 to the second side of the lateral centerline of main body 110 and closer to the lateral centerline than to the second side edge 140 on that side of the lateral centerline.

The side attachment tabs 120 provide wings or flaps for the attachment of the lower ends of the shoulder straps 118. A portion of each side attachment tab 120 is free to be pulled (e.g., swing) away from the main panel. In the illustrated embodiment, the bottom edges, outer side edges and top edges of the side attachment tabs 120 are free and thus the side attachment tabs may swing or otherwise be pulled away from the main panel.

According to one embodiment, all or a portion of each side attachment tab 120 may have a width such that, when the carrier is spread open, the width of the carrier at the side attachment tab 120 is greater than the width of the main body 110 at the same distance from the bottom end of the main body 110. In the illustrated embodiment, the top portions of side attachment tabs 120 (the portions proximate to the respective top edges and distal from the waist belt) have a sufficient length that they can extend past the closest side edges of the main body 110. Side attachment tabs 120 and thigh support tabs 130 are shaped to provide leg openings for a child's legs when the side attachment tabs 120 are pulled away from the main body 110 by the shoulder straps 118.

Each side attachment tab 120 includes an attachment point for a shoulder strap 118. In the illustrated embodiment, for example, each side attachment tab 120 includes an attachment point at which a shoulder strap 118 webbing attachment tab is sewn or otherwise coupled to the exterior side of each side attachment tab 120. Various embodiments of buckling a shoulder strap to a side attachment tab can be used. The use of side attachment tabs 120 directs force from the shoulder straps closer to the center of the carrier away from the side edges 140, thus reducing tension on the outer edges 140 of the carrier and thereby enhancing the child's freedom of movement.

Seat portion 102 forms an adjustable bucket seat configurable to ergonomically position the child's legs and hips. The bucket seat includes a base width adjustment mechanism that is adjustable to adjust the bucket seat as the child grows to support the child in an ergonomic spread squat position appropriate for the weight or size of the child with the child's pelvis, bottom and thighs all being supported. In an ergonomic spread squat position (also known as the "frog leg", "frog", "squat spread" or "M" position), the flexion at the hip joint is at least 90° and in some cases is 110° to 120° from the coronal plane, and the spreading angle can average at approximately 45-55° from the median plane. As the carrier is adjustable, the angle of the hips and spread can depend on the settings of the carrier and developmental stage of the child. In addition, or in the alternative, carrier 100 may include a mid-section width adjuster to adjust top width of the seat to convert the carrier from an inward facing configuration suitable for carrying a child in an inward facing orientation to an outward facing orientation suitable for carrying a child in an outward facing orientation.

In one embodiment, the bucket seat of carrier 100 can be adapted to support the child in a position with the child's femur approximately 90° to 120° (or other elevated position) from the coronal plane and to position the child's knees with an amount of spreading. The amount of spreading may depend on the developmental stage of the child and orientation with a newborn having less than 30°, then approximately 30°, then approximately 35°-40° and so on so, such that the final spread is approximately 40°-45°, though other amounts of spreading may be achieved including (e.g., for example approximately 55°). In one embodiment, the spreading may be at least 20° degrees from the median plane. The child's weight can be distributed across the child's bottom, thighs and back so that the sacrum does not bear too much weight and the child can rest with a more naturally curved "C" spine in a spread squat position that is believed to be better for pelvic development. It can be noted, however, that the child can be positioned in any comfortable position, preferably emphasizing a supportive posture rather than a posture where the child is primarily sitting on his or her sacrum.

Carrier 100 may thus support a variety of configurations. For example, a first configuration may be adapted to support a child of a first size range in a first orientation in a corresponding first spread squat position, a second configuration may be adapted to support a child of a second size range in the first orientation in a second corresponding spread squat position, a third configuration may be adapted to support a child of a third size range in the first orientation in a third corresponding spread squat position. The first configuration may have a first bucket seat base width and first bucket seat depth, the second configuration may have a second bucket seat base width and a second bucket seat depth, and the third configuration may have a third bucket seat base width and a third bucket seat depth. According to one embodiment, the first bucket seat base width is less than the second bucket base seat width, the first bucket seat depth is greater than the second seat bucket depth, the second bucket seat base width is less than the third bucket seat width and the second bucket seat depth is less than the third bucket seat depth. The carrier may be further configurable in a fourth configuration adapted to support a child in a second orientation in a fourth corresponding spread squat position. The first orientation may be an inward facing orientation and the second orientation may be an outward facing orientation. Other embodiments may support additional configurations or fewer configurations.

In accordance with one embodiment, seat portion 102 of carrier 100 comprises a seat center portion 116 and thigh supports 130 disposed on either side of seat center portion 116. Each thigh support 130 may have a lower end portion adapted to selectively couple to the waist belt 105 (or other structure) in multiple positions and an upper end portion adapted to selectively couple to a respective side attachment tab 120 (e.g., side shoulder strap attachment tabs) in multiple positions. Seat center portion 116 and the thigh supports 130 cooperate to form an adjustable bucket seat that is adjustable to support a child in an ergonomic spread-squat position during various stages of the child's growth. The shape of the adjustable bucket seat depends on the positions in which the lower end portions and upper end portions of the thigh supports 130 are coupled to waist belt 105 and side attachment tabs 120.

Thigh supports 130 of seat portion 102 are adapted to pass from the outer side of the child carrying area (the side away from the wearer's torso) to the inner side to form a supportive and adjustable bucket seat. The supportive and adjustable bucket seat can have a generally concave (e.g., "C" shape) inner profile from the inward side to the outward side and from right to left. The side edges of the seat (formed by the edges of thigh supports 130) can be higher than the center of the seat and can be spaced such that the side edges pass under and around the child's thighs at a distance from the child's hips such that the child's legs (e.g., above the knee) do not dangle down. In some embodiments, thigh supports 130 may provide additional support. In particular, in certain embodiments a thigh support 130 may include gathers, elastic material or another type of biasing material. In one embodiment, thigh supports 130 provide areas of thigh padding 132 at least proximate to the outer edges to support the child's thighs.

Carrier 100 comprises a base width adjuster with multiple settings to allow the width of the bucket seat to be adjusted at the waist belt 105. More particularly, the base width adjuster allows the lower end portions 150 of the thigh supports 130 to be selectively coupled to waist belt 105 at multiple locations. The base width adjuster may have a number of forms. In one embodiment, the base width adjuster includes hooks attached to the lower end portions of the thigh supports 130 and multiple attachment points (hanger points) to which the hooks can be attached on the waist belt 105 to selectively couple thigh supports 130 to waist belt 105. In the illustrated embodiment, for example, the base width adjuster comprises hook buckles 152 attached to the thigh supports 130 and a strip of material 154 (e.g., webbing) sewn or otherwise attached to waist belt 105 at multiple spaced locations to form multiple attachment points for the hooks. With this arrangement, the thigh supports 130 can hook to the waist belt 105 at various places to adjust the base width of the bucket seat (i.e., the width of the bucket seat at the waist belt 105. It will be appreciated that attachment points may be provided using other mechanisms, such as, but not limited to, separate loops of material (e.g., fabric, plastic or other material) attached to waist belt 105.

Seat portion 102 may also include one or more shaping members to facilitate shaping the bucket seat. Any suitable shaping mechanism can be used to control the fullness of the bucket seat including, but not limited to darts, pleats, gathers or tucks. In one embodiment, the seat portion includes gussets 160 formed by material attached to seat center portion 116 and thigh supports 130. For example, according to one embodiment the laterally outer edge 162 of each gusset 160 is attached to a respective thigh support 130 and the laterally inner edge 164 of each gusset is attached to the main body. Each gusset 160 may span the gap between the respective thigh support 130 and the seat center portion 116. Gussets 160 may have free top edges and free lower edges (edges proximate to the waist belt).

Gussets 160 can act as darts with edges that can be opened and closed to gather or release the gussets. In particular, by adjusting the positions where thigh supports 130 couple to waist belt 105 to decrease the angle or separation between seat center portion 116 and thigh supports closes gussets 160 and the darts deepen. Consequently, the bucket seat can bulge further and take on a deeper curve. Conversely, adjusting the position where thigh supports 130 couple to waist belt 105 to increase the angle or separation between seat center portion 116 and thigh supports 130 opens gussets 160 and makes the shape formed by gussets 160 shallower. Consequently, the bucket seat formed by the carrier will be shallower.

Figure 4:
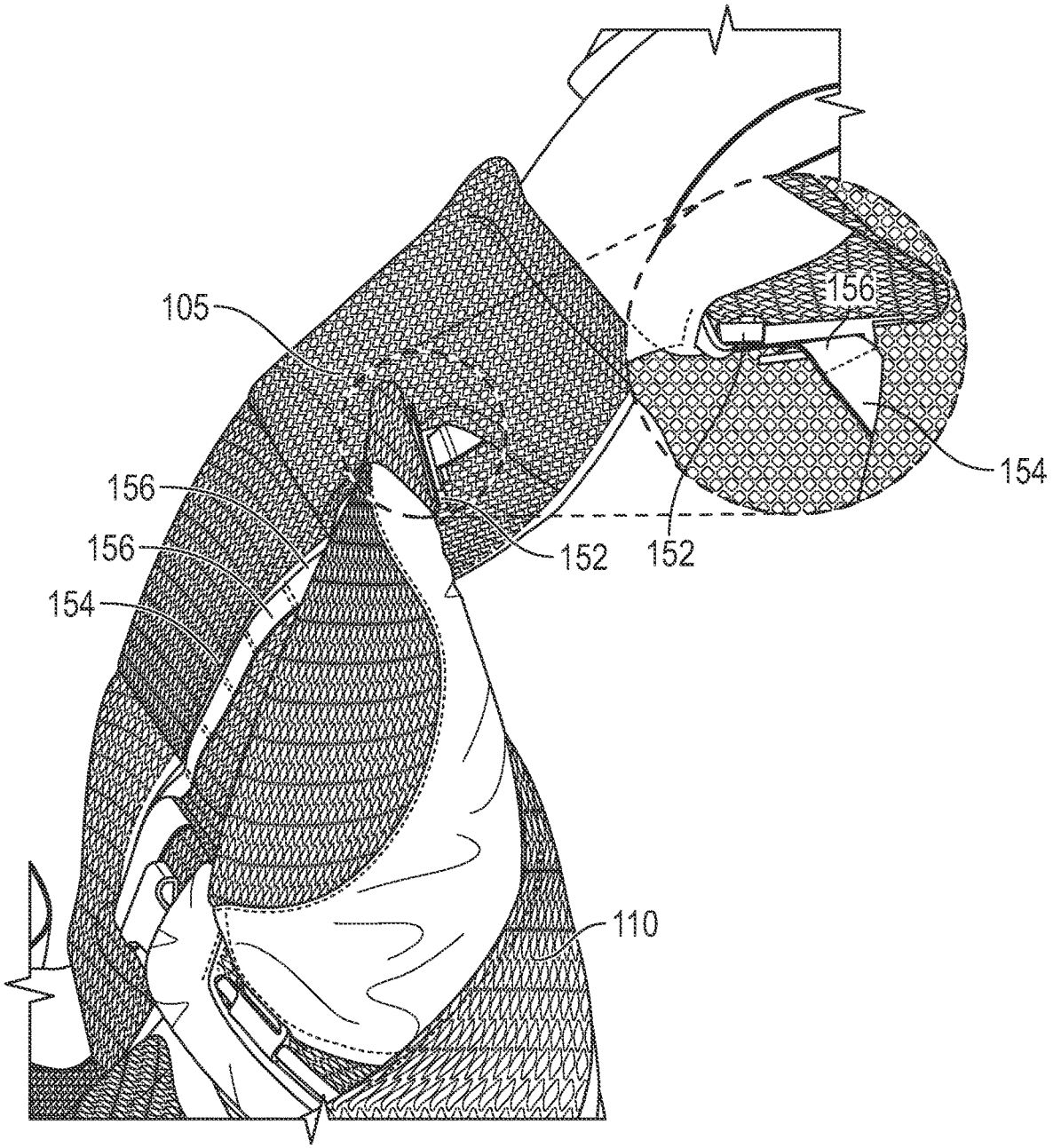
FIG. 4 illustrates one embodiment of a base width adjustment mechanism.

FIG. 4 illustrates one embodiment of a base width adjustment mechanism comprising a hook buckle 152 attached to thigh support 130 and a strip of material 154 that provides multiple hanger points 156 (not all hanger points are indicated) for the hook. As further illustrated in the detail view, the hook buckle 152 is attached to the outermost hanger point 156 for that thigh support 130.

Figure 5C:
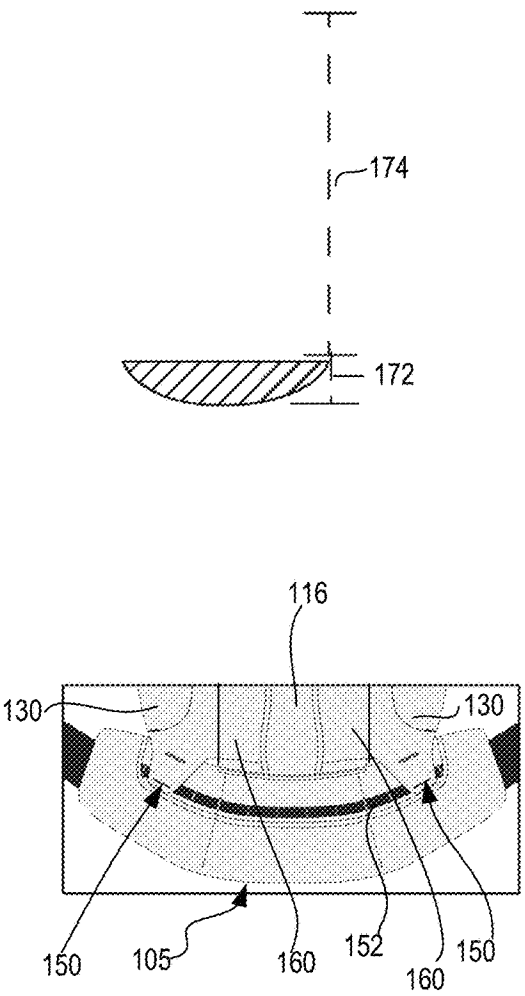
FIG. 5C illustrates one embodiment of a base width adjustment mechanism according to a third setting.
Figure 5B:
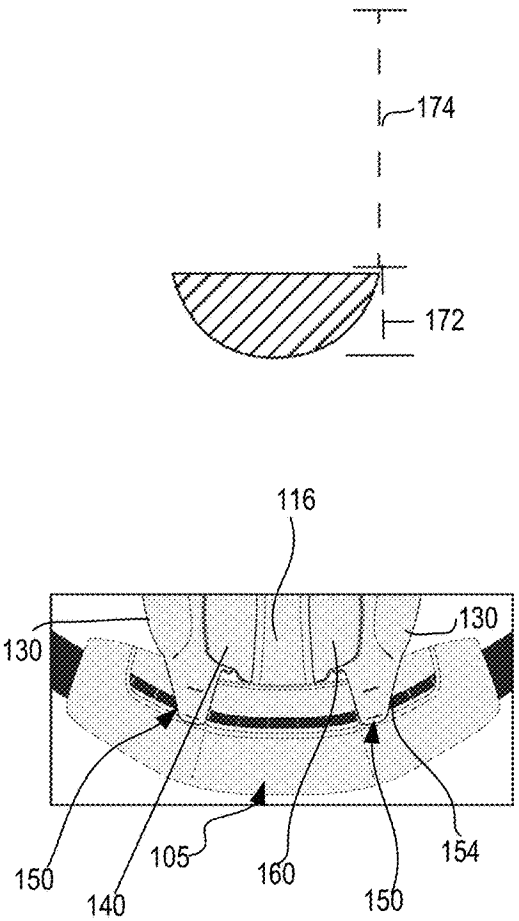
FIG. 5B illustrates one embodiment of a base width adjustment mechanism according to a second setting.
Figure 5A:
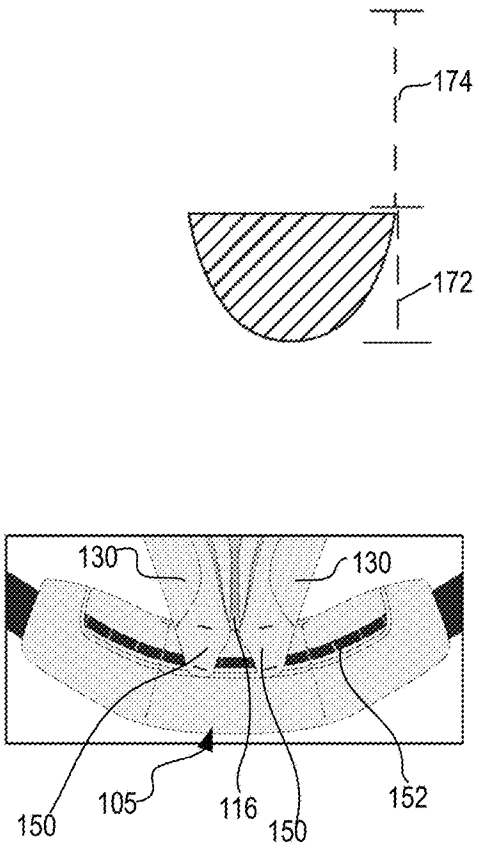
FIG. 5A illustrates one embodiment of a base width adjustment mechanism according to a first setting.

FIG. 5A, FIG. 5B and FIG. 5C illustrate an embodiment in which the base width adjuster is set in various settings. Webbing 154 is curved such that the outermost hanger points are higher than the innermost ones when the carrier is worn. The inside setting results in a minimum base width (FIG. 5A) and the outside setting results in a maximum base width (FIG. 5C). The hanger points 156 and hook buckles 152 can be used to secure the thigh supports to the appropriate setting. The lower end portion 150 of each thigh support 130 can be coupled to the waist belt 105 at multiple positions to achieve various bucket seat shapes.

According to one embodiment, adjusting the base width of the bucket seat also adjusts the depth of the bucket seat. In an even more particular embodiment, decreasing the base width closes the bottom edges of the gussets 160 allowing bucket seat depth 172 (depth at the deepest point of the bucket seat) to increase, whereas increasing the base width opens the bottom edges of gussets 160, decreasing the bucket seat depth 172.

In a minimum (or narrowest) base width setting, as illustrated in FIG. 5A, lower end portions 150 of the thigh supports 130 are coupled to waist belt 105 such that they are maximally proximate to one another (given the range or number of positions possible). In this minimum base width setting, the carrier is configured such that the depth 172 of the seat bucket is at a maximum. In a maximum (or widest) base width setting, such as illustrated in FIG. 5C, lower end portions 150 of thigh supports 130 may be coupled to waist belt 105 such that they are maximally distal from one another given the range or number of possible positions. In this maximum (or widest) base width setting, the carrier is configured such that the depth 172 of the bucket seat is at a minimum.

Further, adjusting the depth of the bucket seat can also adjust the wearable height 174 of the carrier (length from bottom of the bucket seat to the top edge of the torso support portion) because, as more material is used for the bucket seat, less material is available for carrier height and to act as the torso support portion. Thus, adjusted to a smallest child mode (base width at its smallest/narrowest setting), which may be suitable for carrying an infant in some embodiments, the bucket seat is deeper, consuming more of the carrier length measurement, thus leaving less measurement for the wearable height 174. Adjusted to a largest child mode (base width at its largest/widest setting), which may be suitable for carrying a toddler, the bucket seat is shallow, consuming less of the carrier length measurement, thus leaving more measurement for the wearable height 174. The carrier can thus be adjustable for the height of the child by adjusting the bucket seat.

The carrier may have any number of intermediate base width settings (or no intermediate base width settings) between the minimum base width setting and the maximum base width setting to accommodate the child at various stages of growth. FIG. 5B, for example, illustrates an intermediate base width setting in which the bucket seat depth 172 is shallower than that of FIG. 5A, but deeper than that of FIG. 5C, and wearable height 174 is longer than that of FIG. 5A, but less than that of FIG. 5C. Such a setting may be suitable for a young child between the infant stage and toddler stage.

Figure 6:
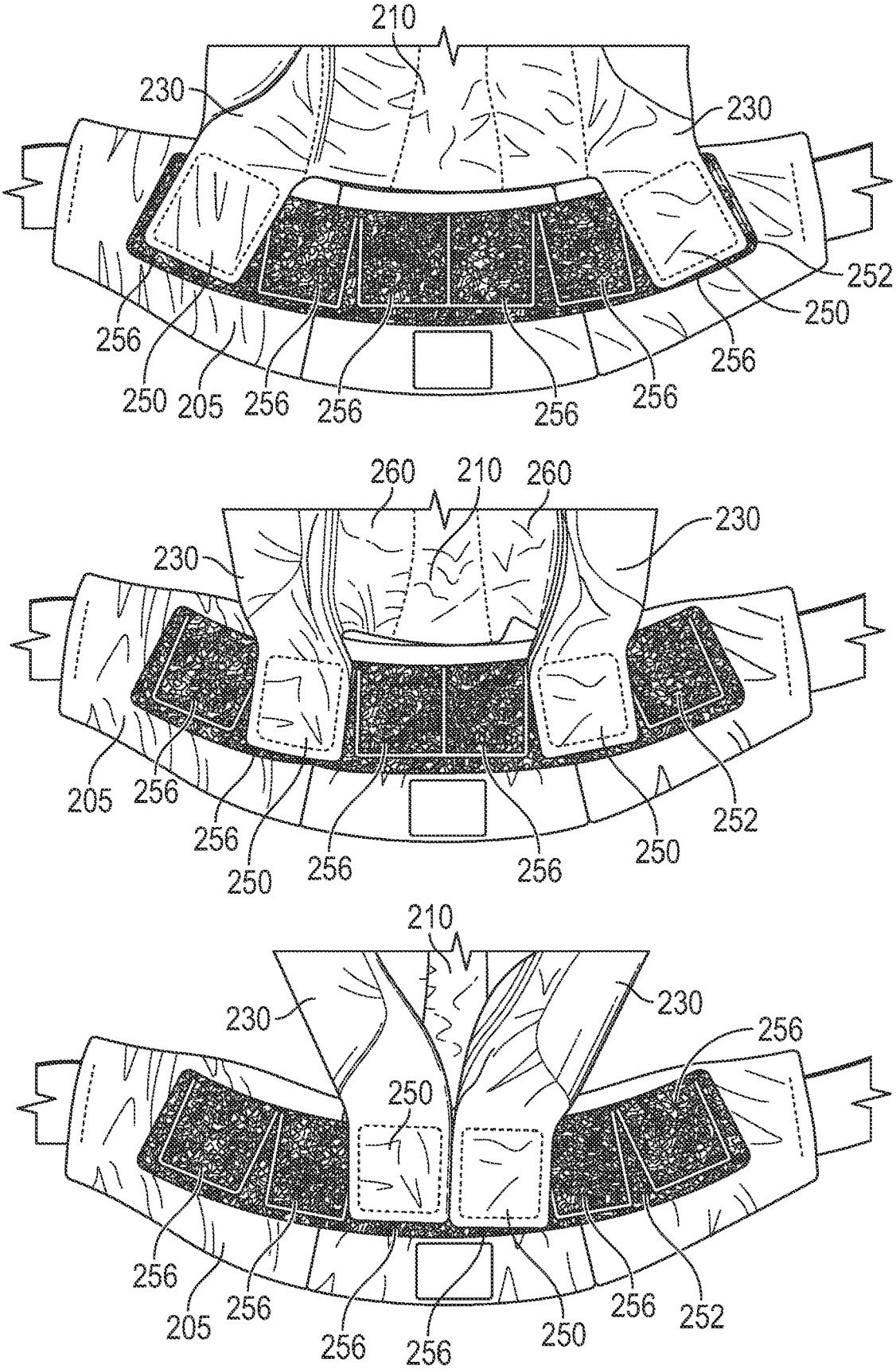
FIG. 6 illustrates another embodiment of a base width adjustment mechanism.

FIG. 6 illustrates another embodiment of a base width adjuster. In the embodiment of FIG. 6, a seat center portion of a main body 210 is coupled to the upper edge of waist belt 205. Thigh supports 230 (e.g., thigh support tabs) cooperate with the seat center portion of a main body 210 to form a bucket seat. Attachment points 256 are provided on waist belt 205 using areas of hook and loop material attached to waist belt 205. The attachment points may be portions of a continuous strip 252 of hook and loop material, separate patches of hook and loop material, or be arranged otherwise. The lower end portions 250 of thigh supports 230 include patches of hook and loop material on the side facing waist belt 205 such that the thigh supports 230 can be selectively attached to waist belt 205 at the attachment points.

Adjusting where thigh supports 230 are attached to waist belt 205 adjusts the base width of the bucket seat at the waist belt 205. Further, adjusting the base width of the bucket seat also adjusts the depth of the bucket seat. In an even more particular embodiment, decreasing the base width closes the bottom edges of the gussets 260, allowing the bucket seat depth (depth at the deepest point of the bucket seat) to increase, whereas increasing the base width opens the bottom edges of gussets 260, decreasing the bucket seat depth. As discussed above, adjusting the bucket seat depth can also adjust the wearable height of the carrier in some embodiments.

The embodiments of FIGS. 5A-5C and FIG. 6 are provided by way of example, but not limitation. Other embodiments may include, for example, buttons, snaps or other types of fasteners on the waist belt to provide attachment points and corresponding features on the thigh supports (or vice versa) so that the thigh supports can be selectively attached to the waist belt at multiple locations to adjust the bucket seat base width. In some embodiments, the base width settings are on the inside of the waist belt, between the waist belt and the wearer.

The user can adjust the bucket seat to support the child in an ergonomic spread squat position appropriate for the weight or size of the child with the child's pelvis, bottom and thighs all being supported. The child's weight can be supported so that the child is squatting in the seat rather than sitting with the child's weight primarily on the sacrum. The child can be supported with the knees higher than the bottom, in some cases higher than 90 degrees. The bucket seat can be adjusted to form a sling or pouch that is wider than the child's hips in which the child's bottom is supported. The thigh supports can be adjusted to pass under and around the child's thighs at a distance from the child's hips such that the portions of the thigh supports that pass under and around the child's thighs are higher than the child's bottom to lift the child's knees. The thigh supports can have sufficient stiffness to encourage the child's thighs to spread by the thigh supports or wearer's torso.

Figure 7C:
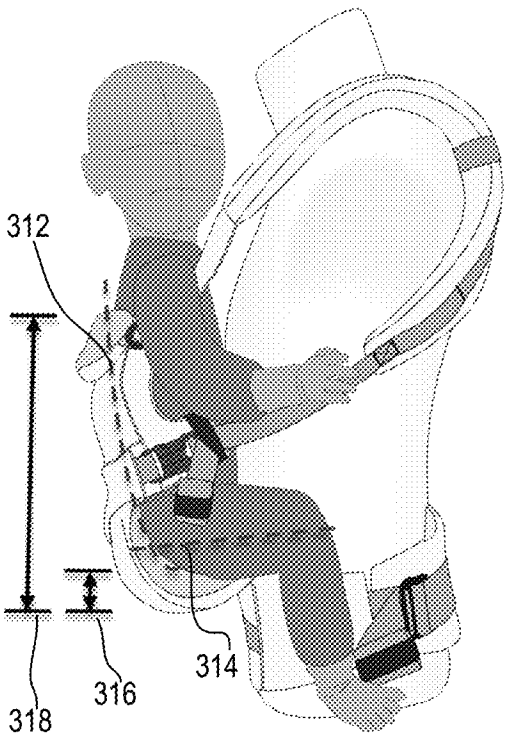
FIG. 7C illustrates one embodiment of a carrier being worn in a front carry, inward facing configuration according to a third base width setting.
Figure 7B:
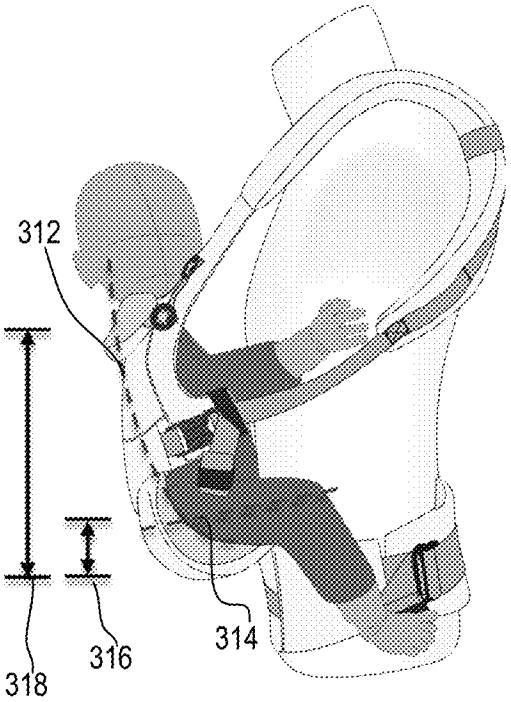
FIG. 7B illustrates one embodiment of a carrier being worn in a front carry, inward facing configuration according to a second base width setting.
Figure 7A:
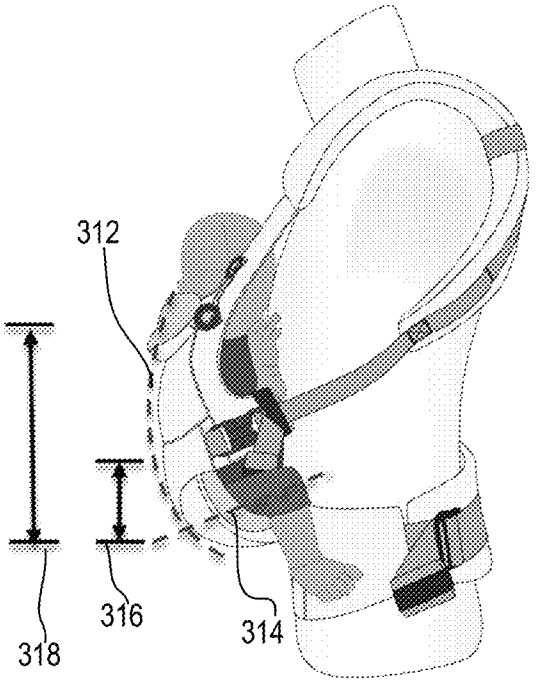
FIG. 7A illustrates one embodiment of a carrier being worn in a front carry, inward facing configuration according to a first base width setting.

The carrier may be adjusted to provide ergonomic support for the child regardless of the size of the child through a supported range. FIG. 7A, FIG. 7B and FIG. 7C, for example, are diagrammatic representations of a side view of one embodiment of a carrier in various configurations. These figures illustrate the shape of the child's spine (line 312), the angle of the child's thigh (line 314), the bucket seat depth 316 and carrier height 318 in the various configurations.

In accordance with one embodiment, the carrier can be set for an infant with base width set to its narrowest settings. In this configuration, as illustrated in FIG. 7A, the bucket seat will be at its deepest with higher walls at the thigh supports lifting the child's thighs and knees to a greater angle and into a spread squat position appropriate for that size child. Moreover, the carrier supports the child in a manner that allows for a deeper c-shape in the child's spine. Similarly, the carrier can be set for the largest child with the base width set at its widest settings (FIG. 7C). In this configuration, the bucket seat may be at its shallowest depth with lower walls at the thigh supports lifting the child's thighs and knees to a lesser angle and into a spread squat position appropriate for a larger sized child. Further, in this configuration, the child's spine has only a moderate c-shape. FIG. 7B illustrates an example of the carrier set to an intermediate setting.

Thus, the adjustable bucket seat is configurable in a plurality of configurations having different seat bucket depths and seat bucket widths. The different configurations can be adapted to support a child in a corresponding size range in a spread squat position. For example, in one embodiment, the bucket seat can have a first configuration adapted to ergonomically carry a child of 20-24 inches (generally corresponding to an infant of 0-3 months and over 7 pounds) in a spread squat position appropriate for the infant without requiring an infant insert. Furthermore, the carrier can have a second configuration adapted to ergonomically carry a child of 24-28 inches (generally corresponding to an older baby of 3-9 months) in a spread squat position appropriate for that child's size. In addition, the carrier, in this example, can have a third configuration adapted to ergonomically carry a child of 28 inches or greater (generally corresponding to an older baby or toddler of 9-48 months (up to the carrying capacity of the carrier or the wearer)). The first configuration can correspond to the base width being at the narrowest setting (deepest bucket seat) (an infant mode), the second configuration can correspond to the base width being at a moderate setting and the third configuration can correspond to the base width being at a widest setting (shallowest bucket seat) (a toddler mode). It can be noted that the ranges provided above are provided by way of example and not limitation.

The carrier may also include a second width adjustment for the bucket seat. In particular, a first side attachment tab 120 may provide a first set of mid-section width setting locations at which the upper end portion of the first thigh support 130 can be set and the second side attachment tab 120 may provide a second set of mid-section width setting locations at which the upper end portion of the second thigh support 130 can be set. Adjusting the upper end portions of the thigh supports adjusts the width of the carrier at a mid-section of the carrier and may be used, for example, to reconfigure the carrier between inward and outward carrying configurations. A mid-section width adjuster may have, for example, an outside setting and an inside setting. For an inward facing orientation, the upper end portions of the thigh supports are positioned on outside settings to provide more coverage for a child's thighs. For an outward facing orientation, the upper end portions of the thigh supports are positioned on inside settings to reduce the spread of the child's thighs. As illustrated in FIG. 3B, the thigh supports in this configuration can still lift the child's thighs to the proper angle.

Figure 8A:
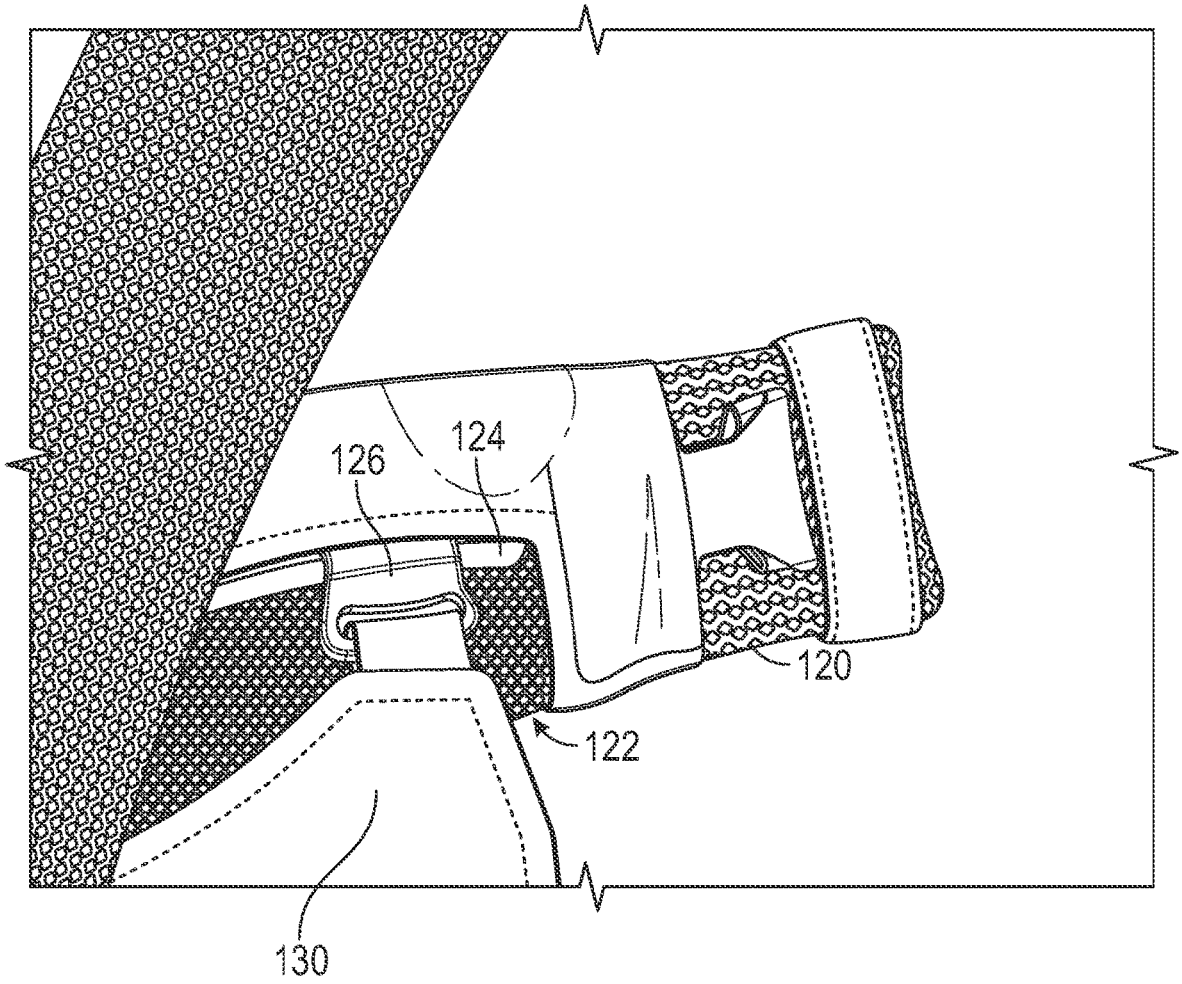
FIG. 8A illustrates one embodiment of a mid-section width adjustment mechanism.
Figure 8B:
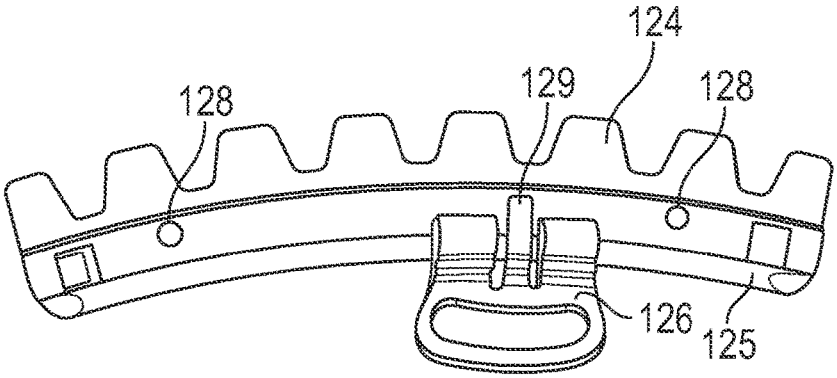
FIG. 8B illustrates one embodiment of a illustrate one embodiment of a slider mechanism.

FIG. 8A and FIG. 8B illustrate one embodiment of a mid-section width adjuster. A pair of slider guide members 124 are coupled to the carrier (for example, to the torso support portion or, as illustrated, to each side attachment tab 120). Each slider guide member 124 provides a slider guide, such as a rail 125. A slider clip (slider) 126 is attached to the upper end portion of each thigh support 130. The slider 126 slides along the rail 125. The slider guide member 124 has multiple slider openings 128 and the slider 126 has a clip pin 129 adapted to engage the openings. For example, the slider guide member 124 may have a slider opening 128 for an inside setting and a slider opening 128 for an outside setting. The slider clip pin 129 can clip into openings to releasably lock slider in position based on the material properties of the clip pin or via a biasing member such as a spring. In the illustrated embodiment there are two slider openings 128, but other embodiments may support additional positions. The use of a guide and slider is provided by way of example and not limitation. A variety of mechanisms can be used to provide mid-section width adjustment such as clips, buttons, snaps, hooks on the thigh supports and hanger points on the side attachment tab 120 (or torso support portion) or other adjustment mechanisms.

Thus, in some embodiments the carrier may have one or more configurations suitable for an inward facing child and one or more configurations suitable for an outward facing child. For example, the child carrier may be adjustable to a first, second and third configuration that have a mid-section width setting that corresponds to an outer setting suitable for a child in an inward facing orientation, whereas the fourth configuration may have a mid-section width that corresponds to the inner setting an outward facing orientation. It can be noted that, in some embodiments, the outward facing orientation is limited to larger children.

Returning to FIG. 1A-FIG. 1D, carrier 100 may also include an adjustable neck support 170. Adjustable neck support 170 may be extended to increase the center height of the carrier, giving additional back or neck support for a child (depending on the size of the child). Neck support 170 may also be folded back away from the wearer to reduce the height of the carrier (e.g., for non-infant children). Neck support 170 may also be folded down toward the wearer such that it may reside inside the child carrying area to give an infant or other child additional head or neck support. The size, shape and position of neck support 170 can be selected so that the neck support will fit behind and support the average infant's neck when the neck support is folded into the carrier.

Figure 9:
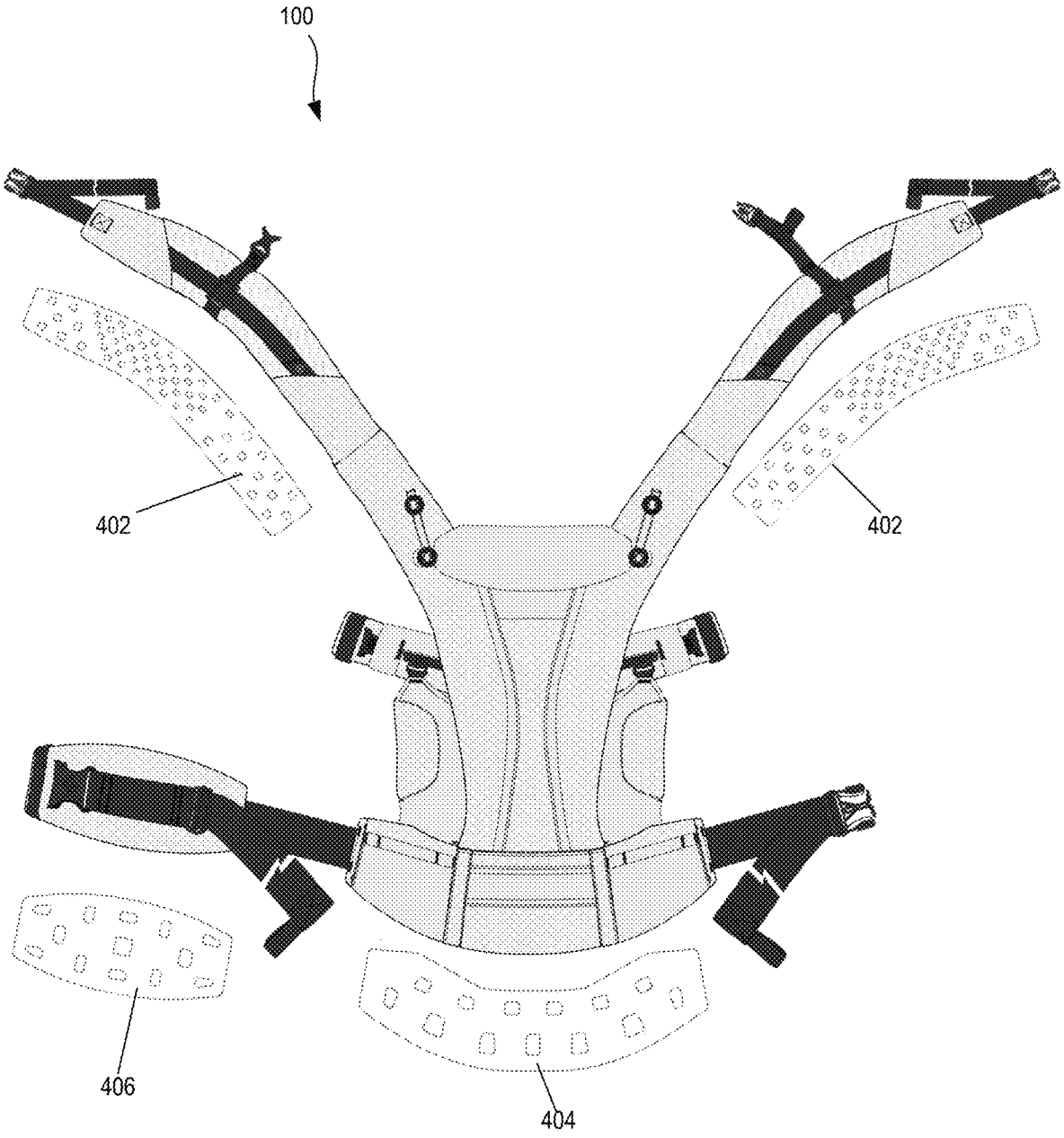
FIG. 9 illustrates one embodiment of a carrier with features to enhance air flow.

In some embodiments, carrier 100 may include features to enhance air flow. FIG. 9 illustrates that some embodiments may include features to enhance airflow. Some embodiments may use perforated EVA (or other material) as padding on the shoulder straps (padding 402), waist belt (padding 404), or lumbar support (padding 406), where the perforated material has designed openings that pass from an inner side to an outer side of the padding for more airflow. It will be appreciated that a variety of materials can be used for padding, such as polyurethane foam or other materials, with or without designed openings for airflow.

Figure 10A:
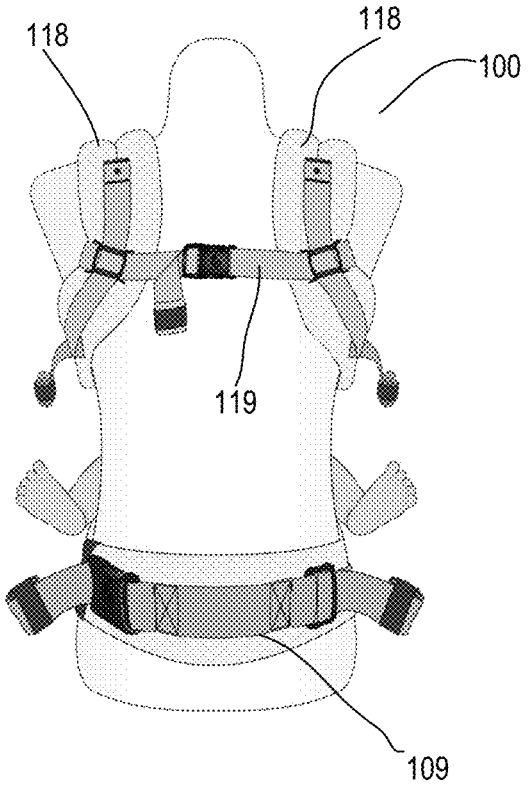
FIG. 10A illustrates one embodiment of a shoulder strap configuration.
Figure 10B:
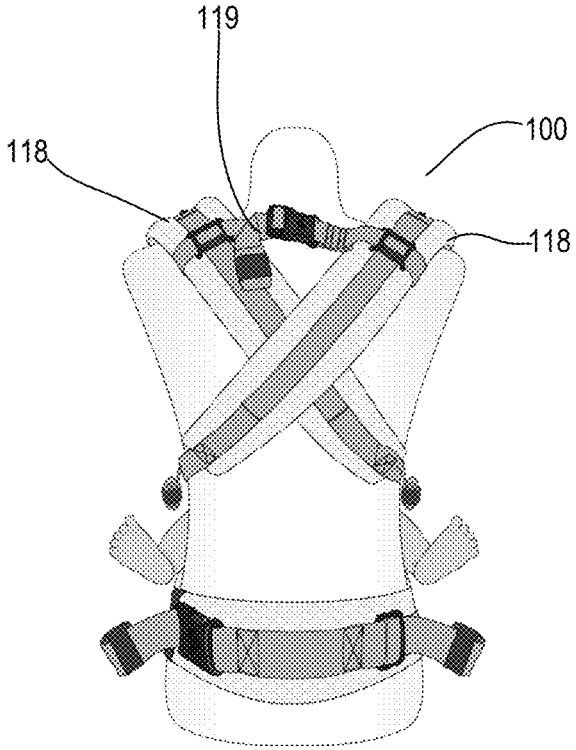
FIG. 10B illustrates another embodiment of a shoulder strap configuration.

FIG. 10 and FIG. 10B illustrates example shoulder strap settings. The shoulder straps 118 of carrier 100 can be configured to form a loop and attach on either side of the lateral centerline of the carrier's main body (FIG. 10A). In other embodiments, the shoulder straps may be worn in an "x" configuration (FIG. 10B). The shoulder straps pull the torso support portion toward the wearer. The shoulder straps may be adjustable and, in some cases, can be re-configured to support multiple carrier positions, such as a front carry, side carry position (hip carry) or back carry position.

Waist belt 105 may have a lumbar support portion (e.g., portion 109) configured to rest on the wearer's hips. Preferably, the harness comprising waist belt 105 and shoulder straps 118 is configured so that the child's weight is evenly distributed to the wearer's hips and shoulders and even more preferably such that the child's weight is distributed evenly to the wearer's hips and shoulders and in some cases primarily to the wearer's hips rather than shoulders. In some cases, 70 percent or more of the child's weight can be distributed to the wearer's hips through waist belt, thereby promoting wearer comfort and diminishing wearer fatigue.

In accordance with one aspect of the present disclosure, the carrier is a soft structured carrier that incorporates padding, stitching and fabrics to provide structure. The torso support portion, seat portion, thigh support tabs, and side attachment tabs can be flexible and can be formed primarily of natural or synthetic fibers without a rigid frame. As would be understood by a person of ordinary skill in the art, however, some components, such as buckles, fasteners, etc. of a soft structured carrier may be formed of hard plastics, metals and the like.

The carrier may include one or more panels formed from a single piece of material or multiple pieces of material, multiple layers of materials, or multiple materials. Inner layers may be selected for comfort against a child's skin and outer layers selected for breathability, fashion, stain resistance, etc.

Embodiments described herein also allow a child to be carried in an outward facing orientation (i.e., facing away from the person carrying the child) or an inward facing orientation (i.e., facing toward the person carrying the child), and further allow the child to be carried on the front or back or to the side of the person carrying the child. In particular, embodiments described herein provide carriers that support the child's bottom, pelvis and thighs in a desired position in both an outward facing orientation and an inward facing orientation. The carrier can be worn by a user in front of, in back of or to the side of the wearer with the child's weight carried near the wearer's center of gravity and close to the wearer's front, back or side in a front, back or side position, respectively.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present). As used herein, a term preceded by "a" or "an" (and "the" when antecedent basis is "a" or "an") includes both singular and plural of such term, unless clearly indicated otherwise (i.e., that the reference "a" or "an" clearly indicates only the singular or only the plural).

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such nonlimiting examples and illustrations include, but is not limited to: "for example," "for instance," "e.g.," "in one embodiment."

Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/Figures should be considered only as exemplary, and not limiting, unless otherwise specifically noted.

The representative embodiments, which have been described in detail herein, have been presented by way of example and not by way of limitation. It will be understood by those skilled in the art that various changes may be made in the form and details of the described embodiments resulting in equivalent embodiments that remain within the scope of the invention.

What is claimed:

1. An adjustable child carrier comprising: a main body adapted to form a child carrying area in cooperation with a wearer's torso, the main body having an interior side and an exterior side and outer edges; shoulder straps configured to lift and support the main body; a pair of side attachment tabs, the pair of side attachment tabs comprising lower attachment points for the shoulder straps; a seat portion comprising: a seat center portion forming: a pair of thigh supports forming an adjustable bucket seat configurable in a plurality of bucket seat configurations to accommodate a plurality of child sizes and carrying orientations, each of the plurality of bucket seat configurations having a bucket seat depth and bucket seat width and adapted to support a child in a corresponding size range in a spread squat position, wherein the pair of thigh supports are adjustable to set a base width of the adjustable bucket seat, and wherein the pair of thigh supports comprises: a first thigh support of the pair of thigh supports, the first thigh support having an upper end portion configured to selectively couple to a first side attachment tab from the pair of side attachment tabs; and a second thigh support of the pair of thigh supports, the second thigh support having an upper end portion configured to selectively couple to a second side attachment tab of the pair of side attachment tabs; a first slider guide member coupled to an exterior side of the first side attachment tab; a first slider coupled to the upper end portion of the first thigh support, the first slider movable along the first slider guide member to attach the first thigh support to the first side attachment tab, wherein the first slider comprises a first pin and the first slider guide member comprises a first opening and a first rail, wherein moving the first slider along the first slider guide member slides the first slider along the first rail such that the first pin inserts into the first opening to thereby attach the first thigh support to the first side attachment tab; a second slider guide member coupled to an exterior side of the second side attachment tab; and a second slider coupled to the upper end portion of the second thigh support, the second slider movable along the second slider guide member to attach the second thigh support to the second side attachment tab, wherein the second slider comprises a second pin and the second slider guide member comprises a second opening and a second rail, wherein moving the second slider along the second slider guide member slides the second slider along the second rail such that the second pin inserts into the second opening to thereby attach the second thigh support to the second side attachment tab.

2. The adjustable child carrier of claim 1, further comprising:

at least one base width adjuster coupled to a lower end portion of the first thigh support and coupled to a second lower end portion of the second thigh support providing a plurality of base width settings.

3. The adjustable child carrier of claim 2, wherein the first side attachment tab and the second side attachment tab each comprise an attachment tab interior side that faces the child when the adjustable child carrier is in use and an attachment tab exterior side opposite the attachment tab interior side;

wherein the first side attachment tab comprises a first lower side attached to the first thigh support and a first upper side attached to the first shoulder strap, and wherein the second side attachment tab comprises a second lower side attached to the second thigh support and a second upper side attached to a second shoulder strap.

4. The adjustable child carrier of claim 1, wherein the main body includes a first side edge to a first side of a lateral centerline of the main body, and a second side edge to a second side of the lateral centerline of the main body;

wherein the first side attachment tab is attached to the main body to the first side of the lateral centerline of the main body, closer to the lateral centerline of the main body than to the first side edge; and wherein the second side attachment tab is attached to the main body to the second side of the lateral centerline of the main body, closer to the lateral centerline of the main body than to the second side edge.

5. The adjustable child carrier of claim 1, wherein the adjustable child carrier is adjustable to provide a plurality of carrier configurations, the plurality of carrier configurations comprising a front inward facing configuration, a front outward facing configuration, and a rear inward facing configuration.

6. The adjustable child carrier of claim 1, wherein the plurality of bucket seat configurations comprises:

a first configuration adapted to support an inward facing child of a first size range in the spread squat position;

a second configuration to support an inward facing child of a second size range the spread squat position;

a third configuration to support an inward facing child of a third size range in the spread squat position; and a fourth configuration to support an outwardly orientated child in the spread squat position, wherein the first configuration has a first bucket seat base width and first bucket seat depth, the second configuration having a second bucket seat base width and a second bucket seat depth, the third configuration having a third bucket seat base width and third bucket seat depth, wherein the first bucket seat base width is less than the second bucket seat base width, the first bucket seat depth is greater than the second bucket seat depth, the second bucket seat base width is less than the third bucket seat base width and the second bucket seat depth is greater than the third bucket seat depth.

7. The adjustable child carrier of claim 1, wherein the adjustable child carrier has a wearable height that is dependent on the bucket seat depth.

8. The adjustable child carrier of claim 1 wherein decreasing the base width of the adjustable bucket seat causes the bucket seat depth of the adjustable bucket seat to increase, and wherein increasing the base width of the adjustable bucket seat causes the bucket seat depth of the adjustable bucket seat to decrease.

9. The adjustable child carrier of claim 1, further comprising a neck support configurable in an inside folded down position in which the neck support is positioned in the child carrying area to support a child's neck.

10. The adjustable child carrier of claim 9, wherein the neck support is further configurable in an extended folded up position and an outside folded down position.

11. The adjustable child carrier of claim 1, wherein the plurality of bucket seat configurations comprises a configuration adapted to support an infant in the spread squat position.

12. The adjustable child carrier of claim 11, wherein the plurality of bucket seat configurations comprises a configuration adapted to support a toddler in the spread squat position.

13. The adjustable child carrier of claim 1, wherein the first side attachment tab and the first thigh support are shaped to form a first leg opening for the child in cooperation with the wearer's torso, and wherein the second side attachment tab and the second thigh support are shaped to form a second leg opening for the child in cooperation with the wearer's torso.

14. An adjustable child carrier comprising: a main body adapted to form a child carrying area in cooperation with a wearer's torso, the main body having an interior side and an exterior side and outer edges; shoulder straps to lift and support the main body; a pair of side attachment tabs, the pair of side attachment tabs comprising lower attachment points for the shoulder straps; a seat portion comprising: a seat center portion forming: a pair of thigh supports forming an adjustable bucket seat configurable in a plurality of bucket seat configurations to accommodate a plurality of child sizes and carrying orientations, each of the plurality of bucket seat configurations having a bucket seat depth and bucket seat width and adapted to support a child in a corresponding size range in a spread squat position, wherein the pair of thigh supports are adjustable to set a base width of the adjustable bucket seat, and wherein the pair of thigh supports comprises: a first thigh support of the pair of thigh supports, the first thigh support having an upper end portion configured to selectively couple to a first side attachment tab from the pair of side attachment tabs; and a second thigh support of the pair of thigh supports, the second thigh support having an upper end portion configured to selectively couple to a second side attachment tab of the pair of side attachment tabs; a first slider guide member coupled to an exterior side of the first side attachment tab; a first slider coupled to the upper end portion of the first thigh support, the first slider movable along the first slider guide member to attach the first thigh support to the first side attachment tab, wherein the first slider comprises a first pin and the first slider guide member comprises a first opening and a first rail, wherein moving the first slider along the first slider guide member slides the first slider along the first rail such that the first pin inserts into the first opening to thereby attach the first thigh support to the first side attachment tab; a second slider guide member coupled to an exterior side of the second side attachment tab; a second slider coupled to the upper end portion of the second thigh support, the second slider movable along the second slider guide member to attach the second thigh support to the second side attachment tab, wherein the second slider comprises a second pin and the second slider guide member comprises a second opening and a second rail, wherein moving the second slider along the second slider guide member slides the second slider along the second rail such that the second pin inserts into the second opening to thereby attach the second thigh support to the second side attachment tab; and at least one base width adjuster configured to adjust a width of body.

15. The adjustable child carrier of claim 14, wherein the at least one base width adjuster is coupled to a first side of the main body at the first thigh support and a second side of the main body at the second thigh support.

16. The adjustable child carrier of claim 14, wherein the adjustable child carrier has a wearable height that is dependent on the bucket seat depth.

17. The adjustable child carrier of claim 14, wherein the first side attachment comprises a first lower side attached to the first thigh support and a first upper side attached to the first shoulder strap, and wherein the second side attachment comprises a second lower side attached to the second thigh support and a second upper side attached to a second shoulder strap.

18. An adjustable child carrier comprising: a main body adapted to form a child carrying area in cooperation with a wearer's torso, the main body having an interior side and an exterior side and outer edges; shoulder straps to lift and support the main body; a pair of side attachment tabs, the pair of side attachment tabs comprising lower attachment points for the shoulder straps; a seat portion comprising: a seat center portion forming: a pair of thigh supports forming an adjustable bucket seat configurable in a plurality of bucket seat configurations to accommodate a plurality of child sizes and carrying orientations, each of the plurality of bucket seat configurations having a bucket seat depth and bucket eat width and adapted to support a child in a corresponding size range in a spread squat position, wherein the pair of thigh supports are adjustable to set a base width of the adjustable bucket seat, and wherein the pair of thigh supports comprises: a first thigh support of the pair of thigh supports, the first thigh support having an upper end portion configured to selectively couple to a first side attachment tab from the pair of side attachment tabs; and a second thigh support of the pair of thigh supports, the second thigh support having an upper end portion configured to selectively couple to a second side attachment tab of the pair of side attachment tabs; at least one slider guide member coupled to an exterior side of the first side attachment tab; at least one slider coupled to the upper end portion of the first thigh support, the at least one slider movable along the at least one slider guide member to attach the first thigh support to the first side attachment tab, wherein the at least one slider comprises a pin and the at least one slider guide member comprises an opening and a rail, wherein moving the at least one slider along the at least one slider guide member slides the at least one slider along the rail such that the pin inserts into the opening to thereby attach the first thigh support to the first side attachment tab; at least one base width adjuster configured to adjust a width of body.

19. The adjustable child carrier of claim 18, wherein the first side attachment tab and the first thigh support are shaped to form a first leg opening for the child in cooperation with the wearer's torso, and wherein the second side attachment tab and the second thigh support are shaped to form a second leg opening for the child in cooperation with the wearer's torso.

20. The adjustable child carrier of claim 18, wherein decreasing the base width of the adjustable bucket seat causes the bucket seat depth of the adjustable bucket seat to increase, and wherein increasing the base width of the adjustable bucket seat causes the bucket seat depth of the adjustable bucket seat to decrease.

* * * * *